US012239179B2

(12) United States Patent
Lacy et al.

(10) Patent No.: US 12,239,179 B2
(45) Date of Patent: Mar. 4, 2025

(54) ELASTIC SIZING MECHANISM

(71) Applicant: Sunday Afternoons, Inc., Ashland, OR (US)

(72) Inventors: Robbin Lacy, Talent, OR (US); Russell Hodgdon, Talent, OR (US); Joey Fallon, Ashland, OR (US); Gulnara Iskhakova, Talent, OR (US); Joey Zachariasen, Talent, OR (US); Acacia Lacy, Ashland, OR (US)

(73) Assignee: SUNDAY AFTERNOONS, INC., Ashland, OR (US)

( * ) Notice: Subject to any disclaimer, the term of this patent is extended or adjusted under 35 U.S.C. 154(b) by 0 days.

(21) Appl. No.: 18/616,694

(22) Filed: Mar. 26, 2024

(65) Prior Publication Data

US 2024/0268502 A1 Aug. 15, 2024

Related U.S. Application Data

(60) Continuation of application No. 17/175,459, filed on Feb. 12, 2021, now abandoned, which is a division of application No. 15/707,938, filed on Sep. 18, 2017, now Pat. No. 10,932,512, which is a continuation of application No. 14/809,038, filed on Jul. 24, 2015, now Pat. No. 9,763,486.

(60) Provisional application No. 62/190,570, filed on Jul. 9, 2015, provisional application No. 62/028,772, filed on Jul. 24, 2014.

(51) Int. Cl.
*A42B 1/22* (2006.01)

(52) U.S. Cl.
CPC ..... *A42B 1/22* (2013.01)

(58) Field of Classification Search
CPC ..... A42B 1/22; A42B 1/24; A42C 5/04
See application file for complete search history.

(56) References Cited

U.S. PATENT DOCUMENTS

| | | | |
|---|---|---|---|
| 2,286,086 | A | 6/1942 | Hamershlag |
| 2,597,555 | A | 5/1952 | Widder |
| 3,217,714 | A | 11/1965 | Silverman |
| 3,263,292 | A | 8/1966 | Fekete |
| 4,481,681 | A | 11/1984 | Hankin |
| 4,502,533 | A | 3/1985 | Nielsen |
| 4,941,210 | A | 7/1990 | Konucik |
| 5,031,246 | A | 7/1991 | Kronenberger |
| 5,378,192 | A | 1/1995 | Darmante |
| 5,432,955 | A | 7/1995 | Plotka et al. |
| 5,657,491 | A | 8/1997 | Young |

(Continued)

*Primary Examiner* — Katherine M Moran
(74) *Attorney, Agent, or Firm* — McCoy Russell LLP

(57) ABSTRACT

Embodiments are disclosed for headwear including a crown and an elasticizing kit, the elasticizing kit including a double-sided sew flange, the double-sided sew flange having a first terminating end opposite a second terminating end, each of the first and second terminating ends including a respective slot for inserting material, a size-adjusting mechanism including at least one strap and adapted to selectively adjust a size of the headwear, the size-adjusting mechanism being coupled to the double-sided sew flange, and an elastomeric strap coupled to the size-adjusting mechanism, the elastomeric strap being attached directly to the slot of the first terminating end of the double-sided sew flange or the slot of the second terminating end of the double-sided sew flange.

10 Claims, 22 Drawing Sheets

(56) References Cited

U.S. PATENT DOCUMENTS

| | | | | |
|---|---|---|---|---|
| 5,715,540 | A | 2/1998 | Cho | |
| 5,909,803 | A | 6/1999 | Clark | |
| 6,049,911 | A | 4/2000 | Bromberg | |
| 6,625,818 | B2 | 9/2003 | Putnam | |
| 6,941,581 | B1 | 9/2005 | England et al. | |
| 7,036,156 | B2 | 5/2006 | Lahman et al. | |
| 7,861,322 | B2 | 1/2011 | Cho | |
| 9,161,584 | B1 | 10/2015 | Garrett, Jr. | |
| 9,763,486 | B2 * | 9/2017 | Lacy | A42B 1/22 |
| 10,104,927 | B2 | 10/2018 | Olcese | |
| 10,932,512 | B2 | 3/2021 | Lacy et al. | |
| 2003/0233696 | A1 | 12/2003 | Lee | |
| 2008/0134414 | A1 | 6/2008 | Cho | |
| 2019/0075875 | A1 * | 3/2019 | Lacy | A42B 1/22 |
| 2021/0259346 | A1 | 8/2021 | Hodgdon et al. | |

* cited by examiner

ELASTIC SIZING MECHANISM

CROSS-REFERENCE TO RELATED APPLICATIONS

The present application is a continuation of U.S. Non-Provisional application Ser. No. 17/175,459, entitled "ELASTIC SIZING MECHANISM," filed on Feb. 12, 2021. U.S. Non-Provisional application Ser. No. 17/175,459 is a divisional of U.S. Non-Provisional application Ser. No. 15/707,938, now U.S. Pat. No. 10,932,512, entitled "ELASTIC SIZING MECHANISM," filed on Sep. 18, 2017, which is a continuation of U.S. Non-Provisional application Ser. No. 14/809,038, now U.S. Pat. No. 9,763,486, entitled "ELASTIC SIZING MECHANISM," filed on Jul. 24, 2015. U.S. Non-Provisional application Ser. No. 14/809,038 claims priority to U.S. Provisional Patent Application No. 62/028,772 entitled "FORAGE HAT," filed on Jul. 24, 2014. U.S. Non-Provisional application Ser. No. 14/809,038 also claims priority to U.S. Provisional Patent Application No. 62/190,570 entitled "ELASTIC SNAPBACK HAT," filed on Jul. 9, 2015. The entire contents of each of the above-identified applications are hereby incorporated by reference for all purposes.

FIELD

The disclosure relates to headwear including an elastic sizing mechanism.

BACKGROUND

Headwear, such as baseball-style caps, may include both fitted and adjustable variations. While fitted caps may be sized for a particular head dimension, adjustable caps provide at least some flexibility in sizing to fit differently-sized heads. An example adjustment mechanism for a cap includes a snapback mechanism which is often formed of a pair of plastic tabs that overlap and engage with one another when fastened. One of the tabs includes a plurality of protruding snaps while the other tab includes a plurality of holes for accepting the snaps. The snapback mechanism allows different head dimensions to be accommodated by engaging an outermost hole on one of the plastic tabs with different protruding snaps on the other of the plastic tabs.

SUMMARY

Embodiments are disclosed for headwear comprising a crown including a cap, and a size-adjusting mechanism extending around a portion of a perimeter of the cap and adapted to selectively adjust a size of the cap. The size-adjusting mechanism may comprise a first tab including a plurality of holes, and a second tab including a plurality of snaps configured to engage with the plurality of holes of the first tab, at least one of the first tab and the second tab being coupled to the perimeter of the cap via an elastic portion attached to a terminal end of a rigid portion of that tab.

BRIEF DESCRIPTION OF THE DRAWINGS

The disclosure may be better understood from reading the following description of non-limiting embodiments, with reference to the attached drawings, wherein below.

DETAILED DESCRIPTION

As described above, adjustable headwear may include snapback mechanisms for selecting a desired circumference of a bottom portion of the cap that engages with a wearer's head (e.g., a sweatband region of the cap). However, the available sizes of other snapback headwear are bound by the number of holes that engage with snaps of the snapback mechanism and the spacings between the holes. In this way, a wearer may have to choose between a slightly loose and a slightly tight fit when wearing other snapback headwear.

In order to address the above-described issues and provide an increased granularity to the available sizes of headwear utilizing snapback mechanisms, the present disclosure provides an elastic snapback mechanism. The elastic snapback mechanism described herein enables a wearer to stretch one or both of the tabs used in the snapback mechanism in order to achieve a comfortably snug fit along a sweatband of the headwear.

Figure 1:
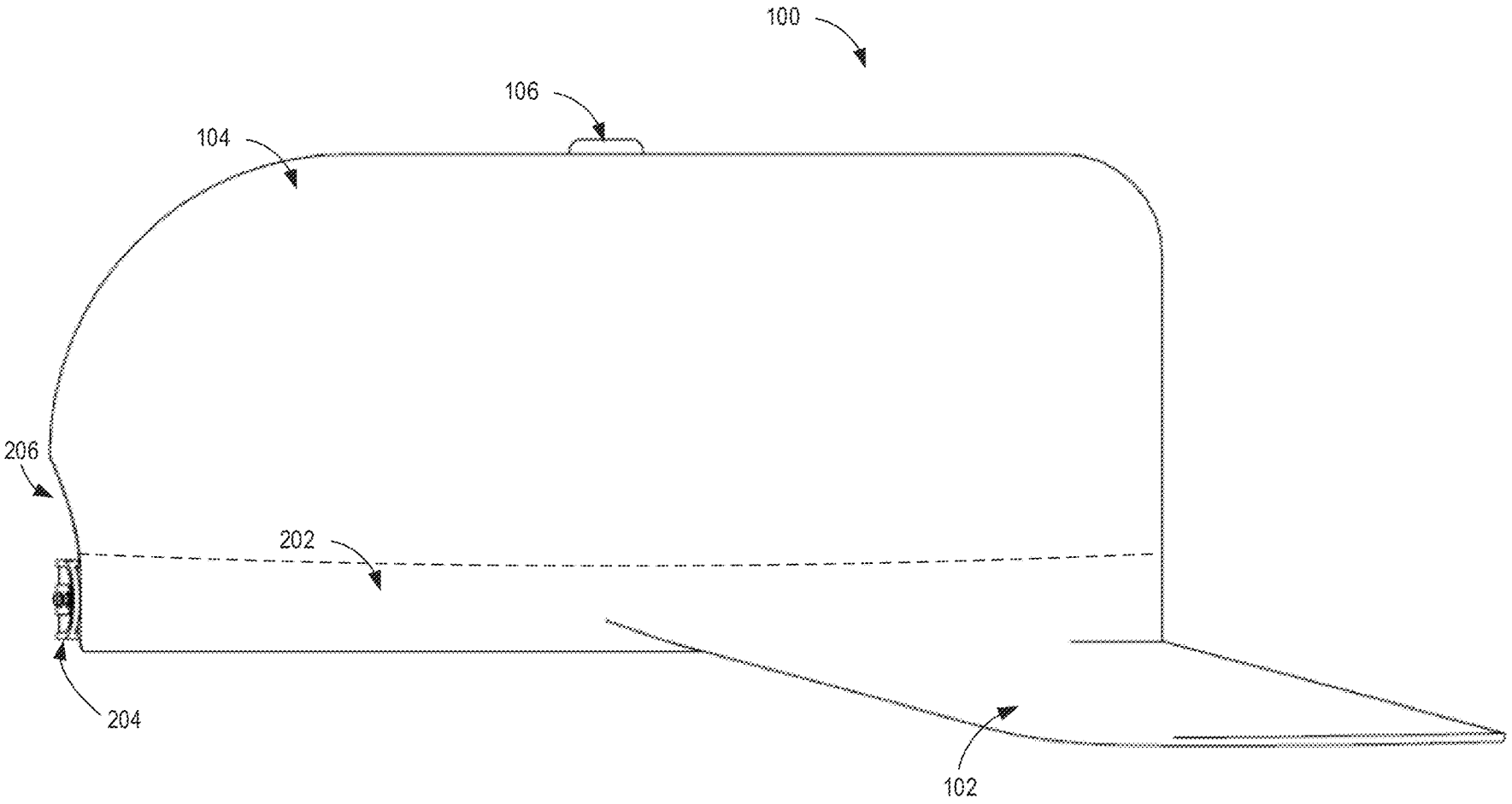
FIG. 1 shows a side view of an example headwear in accordance with one or more embodiments of the present disclosure.

FIG. 1 shows a side view of an example headwear, such as a hat or headwear 100. As illustrated, headwear 100 includes a visor 102 and a crown 104. The visor 102 may be attached to, extend from, and/or otherwise be carried by the crown 104 (e.g., a bottom portion of the crown 104). The crown may comprise a cap configured to extend over a top of a wearer's head. In some embodiments, the crown 104 may include a plurality of panels extending around a circumference of the crown and intersecting at a central region (e.g., affixed to a button 106 on the top of the crown). In other embodiments the crown 104 may be formed of a single panel or piece of fabric (e.g., a unibody construction) forming any suitable hat body shape. In some embodiments, each panel (or the entirety of the crown/visor) may include the same type of fabric or other material. In other embodiments, one or more panels (or the crown) may include a different type of material than the other panels (or the visor).

A headband 202 may extend around at least a portion of the circumference of the crown 104 (e.g., along a bottom edge of the crown, away from the button 106). The headband 202 may form another panel of the crown 104 and/or a junction between the crown and the visor 102. The headband may extend around at least a portion of the circumference and/or perimeter of the base of the crown (e.g., leaving an opening 206 in the back of the crown) and house at least a portion of a sizing mechanism 204. For example, headband 202 may be formed from a substantially rectangular panel that includes terminating ends that are spaced from one another and/or that terminate at tabs of the sizing mechanism 204. The size of the hat may be adjusted by pulling the terminating ends closer to one another (or farther apart) using sizing mechanism 204, which may also adjust a size and/or shape of the opening 206.

Figure 2:
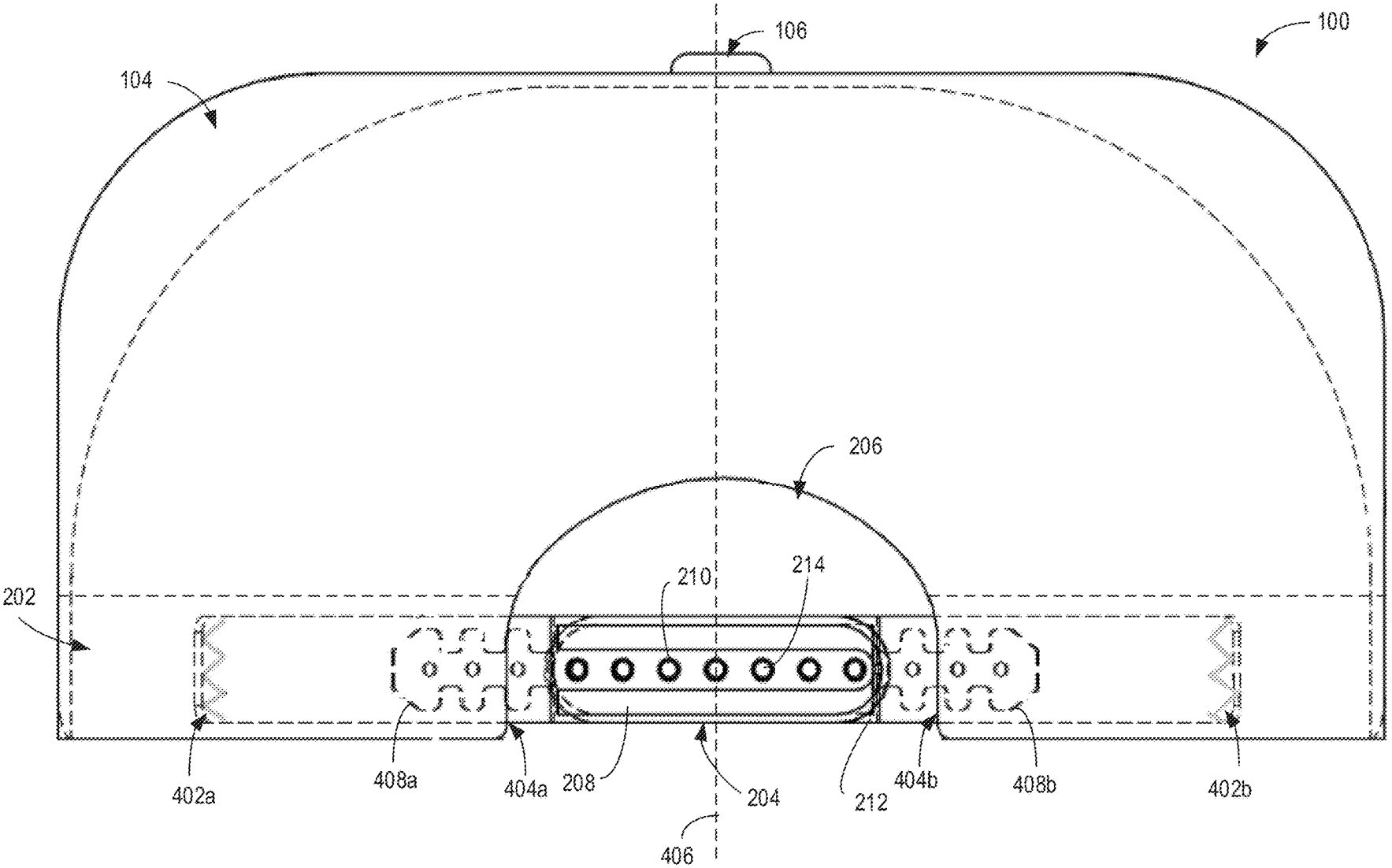
FIG. 2 shows a rear view of the example headwear of FIG. 1 including a snapback adjustment mechanism in accordance with one or more embodiments of the present disclosure.

FIG. 2 shows a rear view of headwear 100 of FIGS. 1 and 2 including a more detailed view of sizing mechanism 204. Sizing mechanism 204, as illustrated, may form an elastic snapback mechanism. Sizing mechanism 204 includes two tabs: a first tab 208 that includes a plurality of holes 210, and a second tab 212 that includes a plurality of protruding snaps 214. The snaps 214 may be sized to engage with holes 210 in a secure manner. For example, the snaps 214 may include a top having a larger diameter than a post from which the top extends. The holes 210 may be formed of a material that is flexible enough to allow the holes to expand and/or stretch slightly to allow passage of the top when the top is inserted into the holes by pressing tabs 208 and 212 together, then constrict under the top to hold the snap in place until a force is applied to pull the tab 208 away from the tab 212.

As shown, the tabs 208 and 212 may extend into a headband region of the headwear 100. For example, the headband 202 may include material that is folded upward from the crown 104 to form a pocket between the headband 202 (e.g., which is configured to come into contact with a wearer) and the outer region of the crown 104. In other embodiments, the headband 202 may be sewn to the crown 104 to form the above-described pocket. One or more of the tabs 208 and 212 may attach to, extend from, and/or otherwise be carried by a) the surface of the headband 202 that is configured to contact the wearer, b) an interior of the above-described pocket formed between the headband and the outer portion of the crown, and/or c) an exterior of the crown (e.g., away from the headband 202 and away from the wearer's head. Although illustrated as occupying a substantially central region of the back of the headwear 100 and/or opening 206, the sizing mechanism may be positioned in other locations in some embodiments. For example, tabs 208 and 212 may be positioned to a side of the opening or off-centered within the opening when engaged with one another (e.g., when one or more snaps 214 are positioned within associated holes 210).

FIG. 2 also shows a detailed view of example internal structures and attachment locations for an elastic sizing mechanism of headwear 100. As illustrated, tabs 208 and 212 may include portions comprising different materials. For example, the portions that engage with one another within the opening 206 may form a first rigid portion that is formed of substantially rigid or non-elastic material. It is to be understood rigid, as used herein, refers to materials that are less elastic than elements described herein as elastic. For example, a substantially hard plastic may still flex and bend, but may not stretch (e.g., along a perimeter of the headwear 100). An elastic portion may include portions of the tabs that attach to the crown 104 in FIG. 2. In contrast to the rigid portions of the tabs, the elastic portions stretch along a perimeter of the headwear 100.

As used herein, the term elastic may refer to the elastic characteristic of the material used in the elastic portion. For example, an elastic portion may include any suitable object or material that is able to resume its normal (e.g., unstretched/resting) shape spontaneously after contraction, dilation, or distortion (e.g., stretching). Elastic portions may include any suitable cord, tap, or fabric, which may be woven with strips of rubber or other elastic/elastomeric materials, and/or other material(s)/composite(s) having the features described above that returns to its original length or shape after being stretched. In some examples, elastic portions may include tape made of plastic or other materials that form a flat, smooth, and/or non-rounded strip that may lie flat with the hat and/or follow contours of the hat such that there are no protrusions that may cause discomfort to a wearer.

In FIG. 2, the attachment points 402*a* and 402*b* of the elastic portions of tabs 208 and 212, respectively, are substantially equally distant from a center of the opening 206. In other words, the attachment points 402*a* and 402*b* may be equally distant from an edge (404*a* or 404*b*) of the opening 206 on an associated side of headwear 100, where the sides of the hat are approximately separated from one another along axis 406 which extends through the center of opening 206. In other embodiments, the distance between the attachment points 402*a*/402*b* of the elastic portions and the center of opening 206 may be different for each attachment point. In such examples, the rigid portion of the tabs 208 and 212 that engage with one another may be off-center with respect to the opening 206 or the elastic portions of tabs 208 and 212 may have different lengths from one another. It is to be understood that attachment or coupling, as used throughout the disclosure, may refer to any suitable coupling mechanism, including but not limited to attaching, stitching, gluing, adhering, chemical bonding, sewing, etc. Particular coupling mechanisms may be performed to provide advantages relating to that coupling mechanism, and disclosure of a particular coupling mechanism to join two or more elements together may be understood to also cover the disclosure of any other suitable coupling mechanism to join those two or more elements together.

The attachment points 402*a* and 402*b* may include one or more attachment mechanisms. For example, the elastic portions of the tabs may be attached to the crown and/or headband via stitching, gluing, grommets, magnets, and/or any other suitable mechanical or chemical fastening mechanism. Although only one attachment point is shown for each tab 208 and 212, it is to be understood that the elastic and/or rigid portions of the tabs may be attached to the crown and/or headband via two or more attachment points. It is to be further understood that any of the above-described attachment mechanisms may be used in any combination to provide the attachment points for each of the tabs.

As shown at 408*a* and 408*b*, the tabs 208 and 212, respectively, may include a rigid spine. The rigid spine may be another rigid portion of the tabs that is configured to provide structural support for the corresponding elastic portion of that tab. The rigid spines 408*a* and 408*b* may include a rectangular strip of rigid material having a plurality of protrusions spaced from one another and extending from the rectangular strip toward a bottom and a top of the headwear. The rigid spines 408*a* and 408*b* may be encased in and/or integrated with a portion of the elastic portion of the respective tabs 208 and 212. For example, the elastic material may be overmolded over the rigid spines such that the elastic material is adjacent to all surfaces of the rigid spines, thereby integrating the rigid spines into the elastic material. The rigid spines may extend from an attachment point of a first rigid portion of the respective tab (e.g., the rigid portion that is exposed and/or configured to engage with the rigid portion of the other tab) to the elastic portion of the respective tab, and may terminate prior to reaching an attachment point of the elastic portion of the respective tab to the crown 104 and/or headband 202. The rigid spines may include one or more holes for increased flexibility and to allow the elastic material to attach to an increased surface area of the rigid material, creating further chemical and mechanical bonds between the two materials. Although each tab is illustrated as including a rigid spine, it is to be understood that in other embodiments, only one tab or neither tab may include a rigid spine.

It is to be understood that the rigid spines may have any suitable arrangement, shape, position, etc. For example, one or more rigid spines may be positioned at any region along the length of the elastic portion of a tab (e.g., closer to an opening in the crown, closer to an attachment point of the tab to the hat/headband, in a center of the tab, etc.) and/or along a height of the elastic portion of the tab (e.g., closer to the top of the tab, closer to the bottom of the tab, at a center of the tab, etc.). If both tabs of the hat include a spine, the spine(s) of one tab may be located in a different region of that tab than the spine(s) of the other tab. In additional or alternative non-limiting examples, a plurality of spines may be distributed next to each other along a length of a tab (e.g., spaced from one another or adjacent to one another with contacting surfaces) and/or distributed above/below each other along a height of the tab (e.g., spaced from one another or adjacent to one another with contacting surfaces). In further additional or alternative non-limiting examples, one or more spines of a hat may have different structural features, such as irregularly spaced/sized protrusions from a center of the spine, dimples or detents in regions of the spine, spikes or jagged edges along the spine, rough and/or smooth material along different regions of the spine, etc. In some non-limiting examples, the material used in the spine may differ in different regions of the spine. The spine may also have different thicknesses in different regions of the structure. As a non-limiting example, protrusions of the spine may be thinner than a center of the spine. It is to be understood that other example configurations of rigid material may be provided to form the spines described herein.

Figure 3:
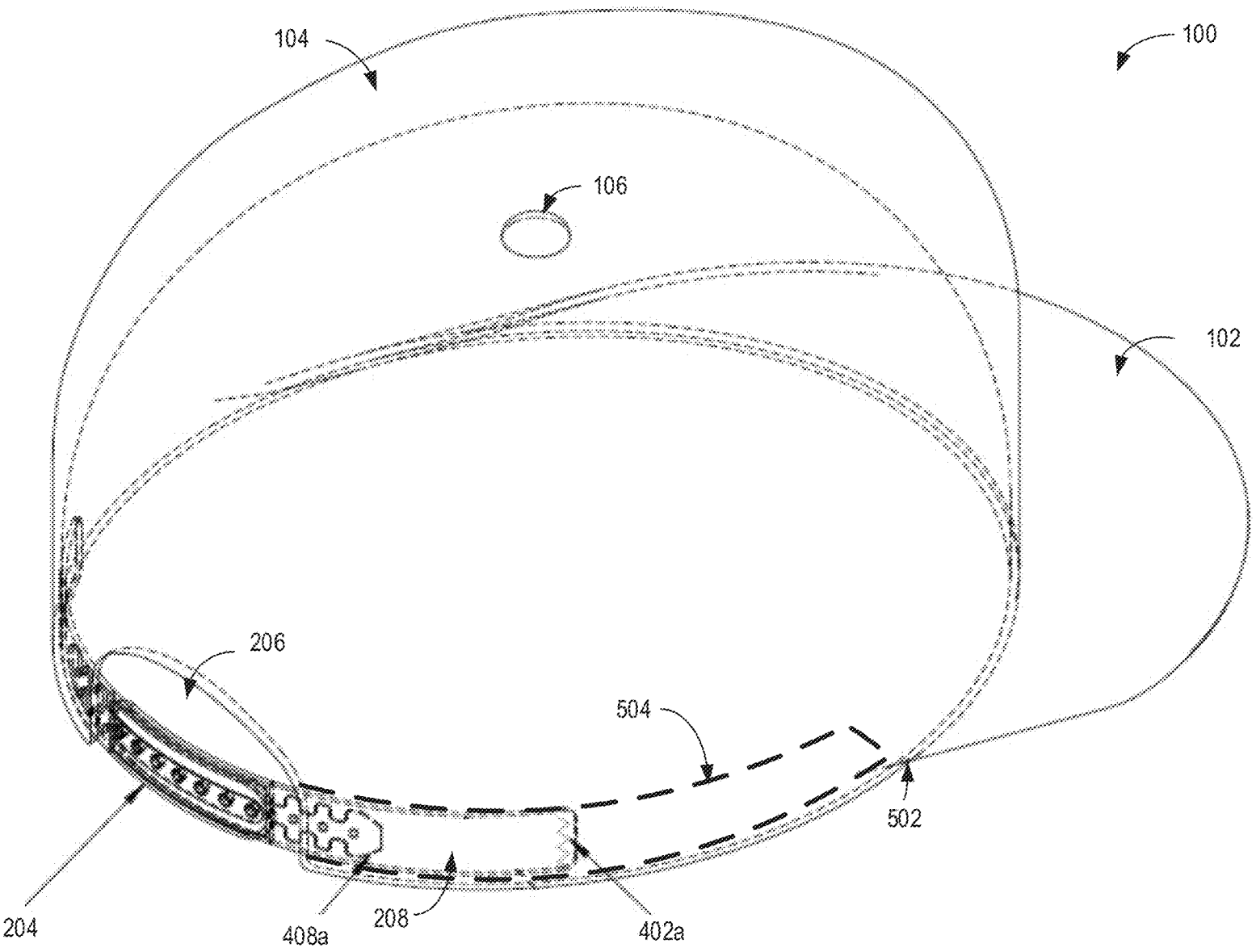
FIG. 3 shows a bottom isometric view of the example headwear of FIG. 1 in accordance with one or more embodiments of the present disclosure.

FIG. 3 shows an isometric view of a bottom of headwear 100. As illustrated, attachment point 402*a* is located between an edge of the opening 206 and an edge 502 of the visor 102 (e.g., a location at which the edge of the visor intersects with the crown 104). In other examples, the respective elastic portion of each of the tabs may be configured to extend along less than half of the circumference of the perimeter of the crown. For example, the elastic portion of tab 208 may attach to the crown and/or headband/sweatband along one or more points in attachment region 504. In this way, the elastic portion of tab 208 may extend from the rigid portion of tab 208 to any location along the perimeter of the crown 104 between the opening 206 and the edge 502 of visor 102. In other examples, the attachment region may extend to occupy approximately half of the perimeter of the crown 104. It is to be understood that the elastic portion of tab 208 may extend from the rigid portion of tab 208 to any location along the perimeter of the crown in some examples, including but not limited to extending all of the way around the perimeter to another rigid portion of a tab on the opposite side of opening 206 from tab 208. The perimeter of the crown may also include multiple sections of material having different properties, each section of material joined to another section of material at different regions along the perimeter. For example, elastic portion of tab 208 may attach to the crown and/or headband/sweatband along one or more points in attachment region 504, and another region of elastic material may extend between two additional points along the perimeter of the crown.

Figure 4A:
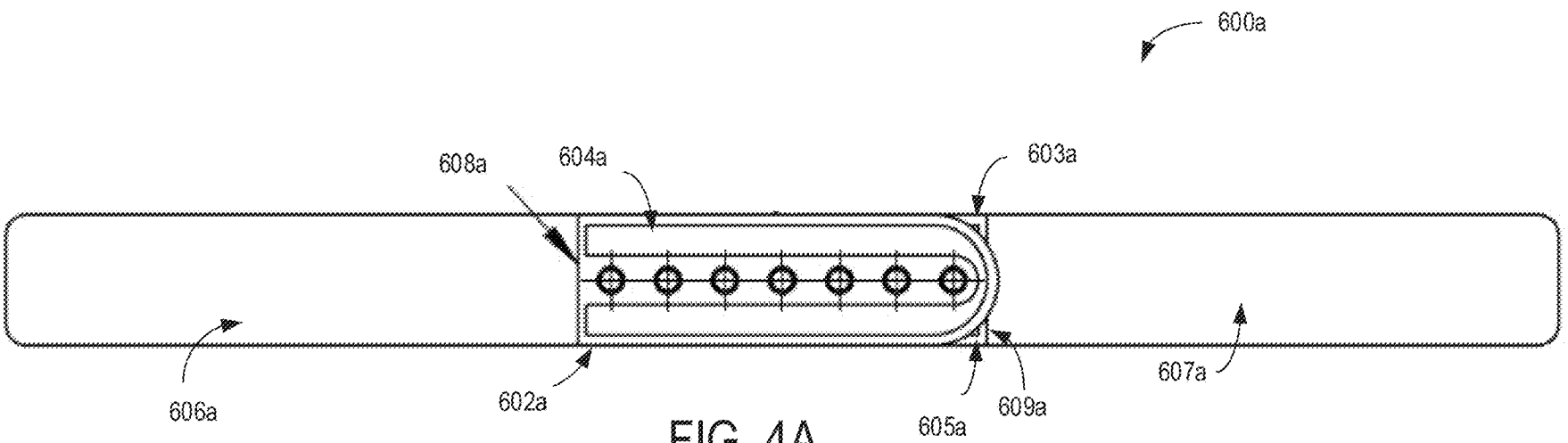
FIGS. 4A and 4B show a detailed view of example snapback adjustment mechanisms in accordance with one or more embodiments of the present disclosure.
Figure 4B:
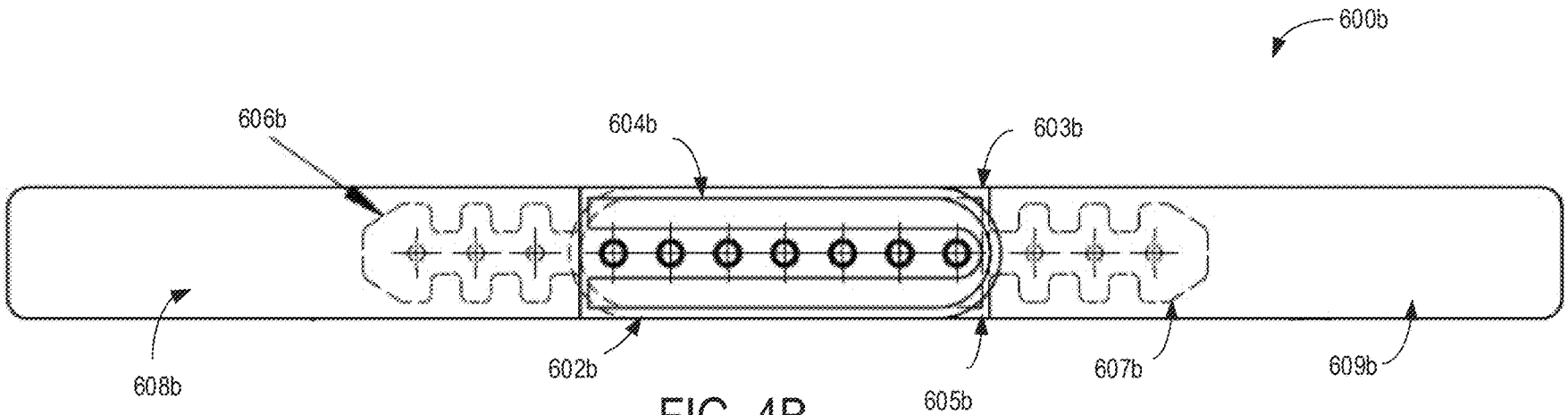

FIGS. 4A-4B show example elastic snapback sizing mechanisms 600*a* and 600*b*. In FIG. 4A, a first tab 602*a* includes a rigid portion 604*a* with a plurality of holes for engaging with a second tab 603*a*. First tab 602*a* also includes an elastic portion 606*a* (e.g., an elastic strap) extending from an attachment point 608*a* at which the elastic portion 606*a* is joined to the rigid portion 604*a*. Second tab 603*a* includes a rigid portion 605*a* and an elastic portion 607*a*, which join at an attachment point 609*a*.

In FIG. 4B, tabs 602*b* and 603*b* include two rigid portions each—the first rigid portion 604*b*/605*b*, which engages with the other first rigid portion of the other respective tab, and second rigid portion 606*b*/607*b* (e.g., a rigid spine), which does not engage with the other tab. The tabs also include respective elastic portions 608*b*/609*b*.

Figure 5:
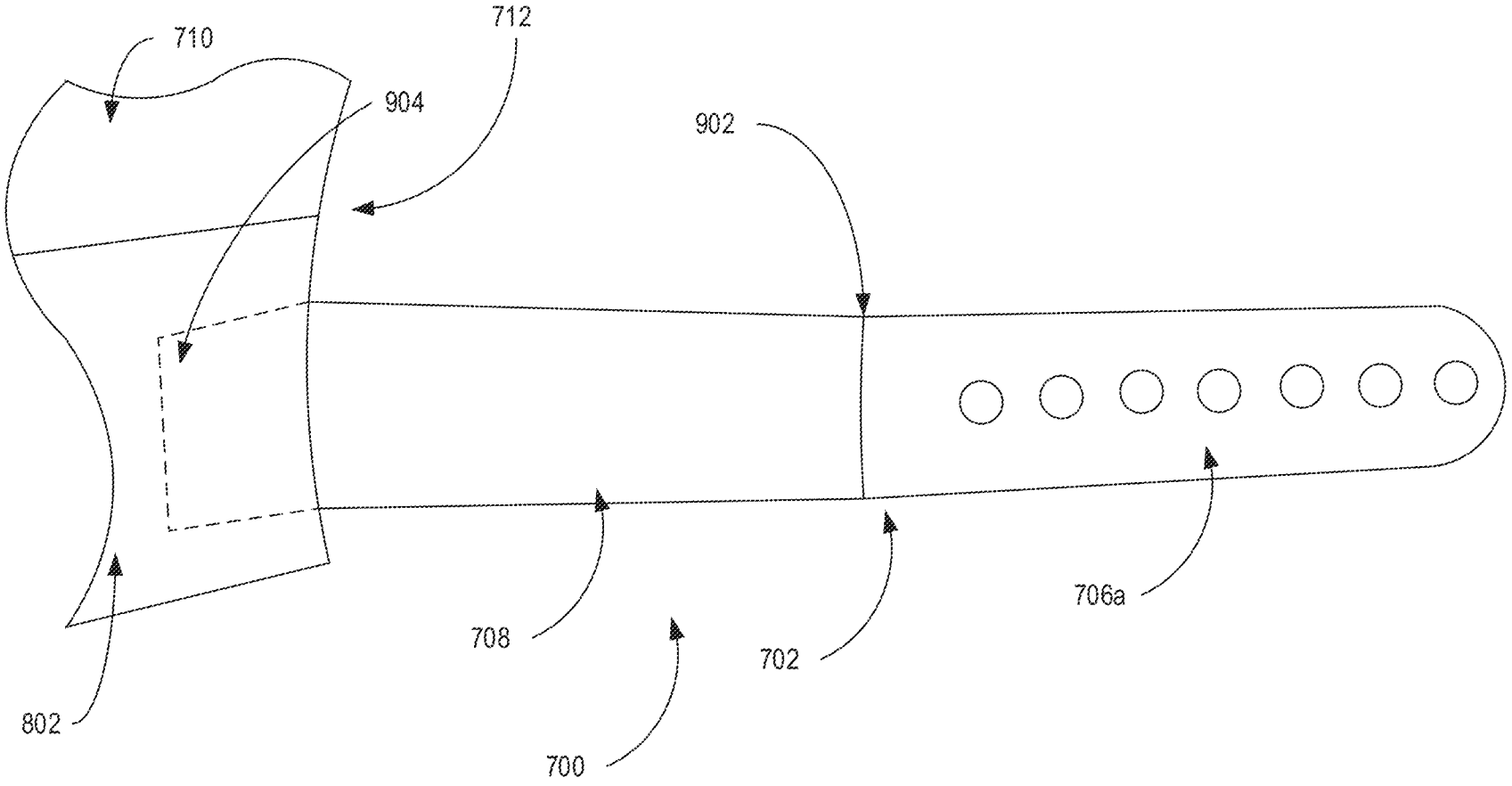
FIGS. 5 and 6 show example unlatched tabs of an example snapback mechanism in accordance with one or more embodiments of the present disclosure.
Figure 6:
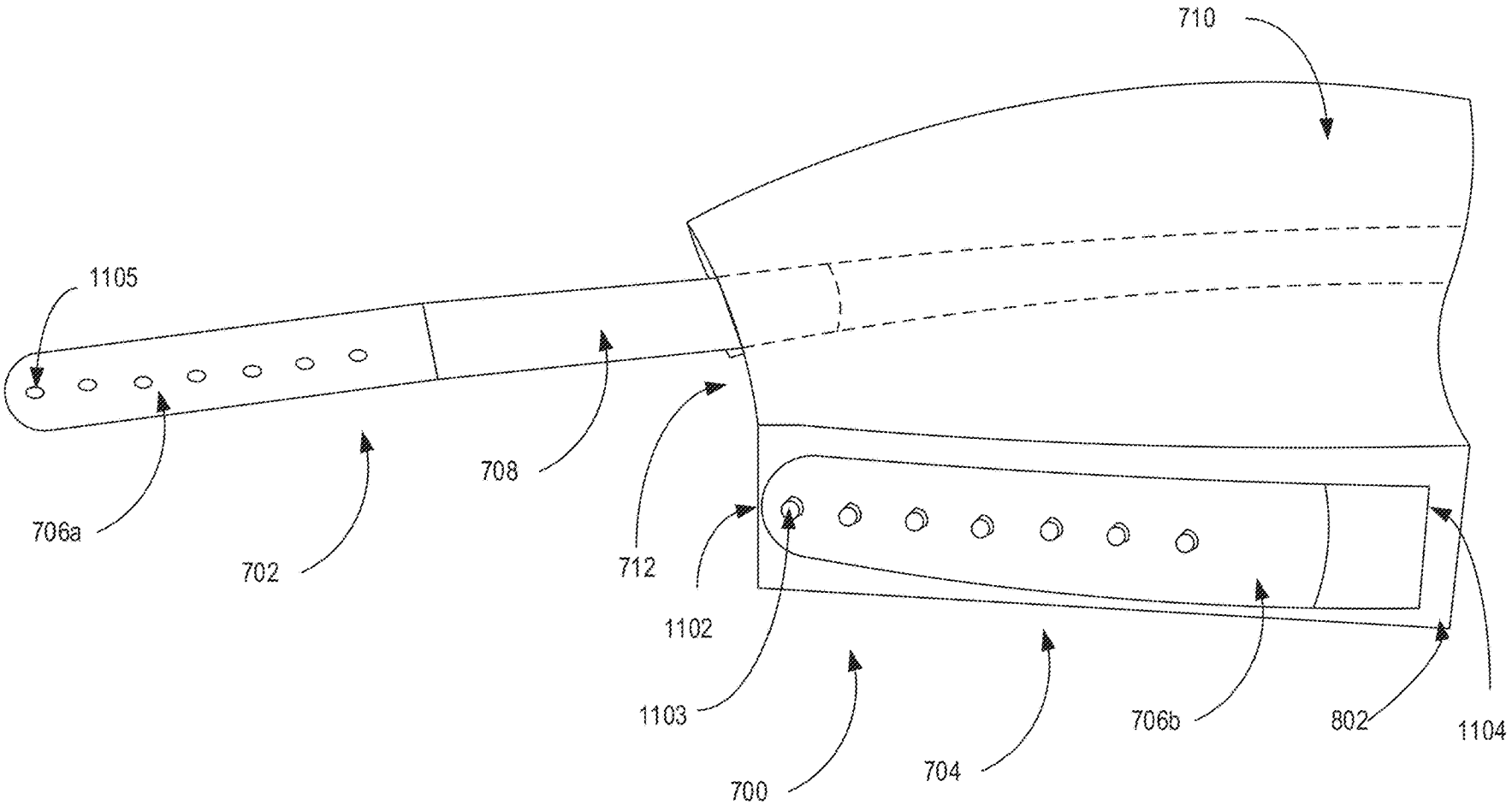

FIGS. 5 and 6 show an example snapback mechanism 700 positioned off-centered from a rear of a hat and including a sheathed elastic portion. As illustrated therein, the snapback mechanism 700 includes a first tab 702 and a second tab 704. The first tab 702 includes a rigid portion 706*a*, which includes a plurality of holes for engaging snaps of the second tab 704. Attached to a terminal end of the rigid portion 706*a* is an elastic portion 708. In this example, the elastic portion 708 comprises an elastic strip (e.g., a rectangular elastic strip of material) sheathed and/or housed within a rigid and/or less elastic material (e.g., fabric). The sheathing material is configured to accommodate the length of the elastic strip when the elastic strip is stretched (e.g., when stretched to a maximum length of the elastic strip). Accordingly, while the elastic strip is not stretched (e.g., to the maximum length), the sheathing material gathers or bunches around the elastic strip.

The second tab 704 only includes a rigid portion 706*b*, which is attached to an outer surface (e.g., away from a wearer when worn) of the crown 710. The rigid portion 706*b* includes a plurality of snaps configured to be inserted and secured within holes of the rigid portion 706*a* of the first tab 702 when the sizing mechanism 700 is in a locked position. As illustrated, the second tab 704 only occupies a region of the hat on one side of opening 712 in the crown 710, and does not extend within the opening 712.

The elastic portion 708 of the first tab 702 may be positioned such that it is sandwiched between an outer portion of the crown 710 of the hat and a headband/sweatband 802 (shown in more detail in FIG. 6). For example, the elastic portion 708 passes through a pocket formed between the crown 710 and the headband/sweatband 802. For example, the elastic portion 708 may extend around the perimeter of the crown 710 to the side of opening 712, but may be at least partially obscured by the crown on the outer region of the hat and the headband/sweatband on the inner region of the hat.

FIGS. 5 and 6 show the tabs of snapback mechanism 700 in an example unlatched (e.g., unsecured to one another) configuration. FIG. 5 shows an unlatched first tab 702. In some examples, the elastic portion 708 includes two terminal ends opposite of one another. A first terminal end 902 of the elastic portion 708 is attached to a terminal end of rigid portion 706*a*. In the illustrated example, both the elastic strip within the sheathing material and the sheathing material itself is attached to the terminal end of the rigid portion 706*a*. A second terminal end 904 of the elastic portion 708 is attached to the hat between the crown and the headband/sweatband. As illustrated, the second terminal end 904 is attached a short distance from an edge of opening 712 of the crown 710. However, it is to be understood that the second terminal end 904 may be attached directly to the edge of the opening 712 and/or any suitable distance from the edge of the opening 712 (e.g., extending up to halfway around the perimeter of the crown 710 and/or between the edge of the opening and an intersection of a visor of the hat and the crown on that side of the hat). It is to be further understood that the attachment point on the elastic portion 708 may not be positioned at the edge of the second terminal end 904. For example, a small amount of the elastic portion 708 (e.g., less than 5% of the total length of the elastic portion when the elastic is not stretched) may extend past the attachment point of the elastic portion 708 to the hat. The attachment point may include an attachment to the crown 710 and/or the headband/sweatband 802, and multiple attachment points may be provided in some examples.

FIG. 6 shows a rear view of unlatched first tab 702 and an unlatched second tab 704. The unlatched second tab 704 includes two terminal ends opposite of one another. A first terminal end 1102 includes an outermost snap 1103, which may be utilized to provide the largest hat/crown size when the outermost hole 1105 of the first tab 702 is secured thereto (e.g., in a latched configuration). In the illustrated example, the first terminal end 1102 is positioned at an edge of opening 712 in crown 710. A second terminal end 1104 of the second tab 704 is positioned at a point along a perimeter of crown 710 away from opening 712. Accordingly, in the illustrated example, the second tab 704 is positioned on one side of the opening 712 and does not extend past the opening 712. It is to be understood that in other examples, one or both of the terminal ends of a second tab may extend past the edge of the opening 712 (e.g., toward an opposite side of the opening).

As the second tab 704 is positioned to the side of the opening 712, the second tab 704 may be attached to the hat (e.g., to the crown 710 and/or the headband/sweatband 802) in multiple locations. For example, both the first and second terminal ends 1102 and 1104 may be attached to the crown 710. In other examples, the entire length of the second tab 704 may be attached to the crown (e.g., by stitching, adhesives, and/or other attachment mechanisms that span the length of the tab and/or a circumference/perimeter of the tab). Any suitable number of attachment points and/or portion of the second tab 704 may be attached to the hat. While the second tab is illustrated as facing an outer surface of the hat (e.g., attached on the outer surface of the crown 710), in other examples, the second tab 704 may be attached to an inner surface of the hat. For example, the second tab 704 may be rotated such that the snaps extend into an interior of the hat (e.g., opposite of the illustrated direction), and the second tab may be secured to an inner surface (e.g., a wearer-side surface) of the headband/sweatband 802. Such an arrangement may enable the snapback mechanism to be hidden on an interior of the hat. As such an arrangement may cause the snapback mechanism to directly contact a wearer's head, a moveable flap of material or other covering mechanism may be added over the mechanism to allow access to the snapback mechanism during adjustment while providing a barrier between the mechanism (e.g., the rigid portions of the mechanism) and the wearer.

Figure 7:
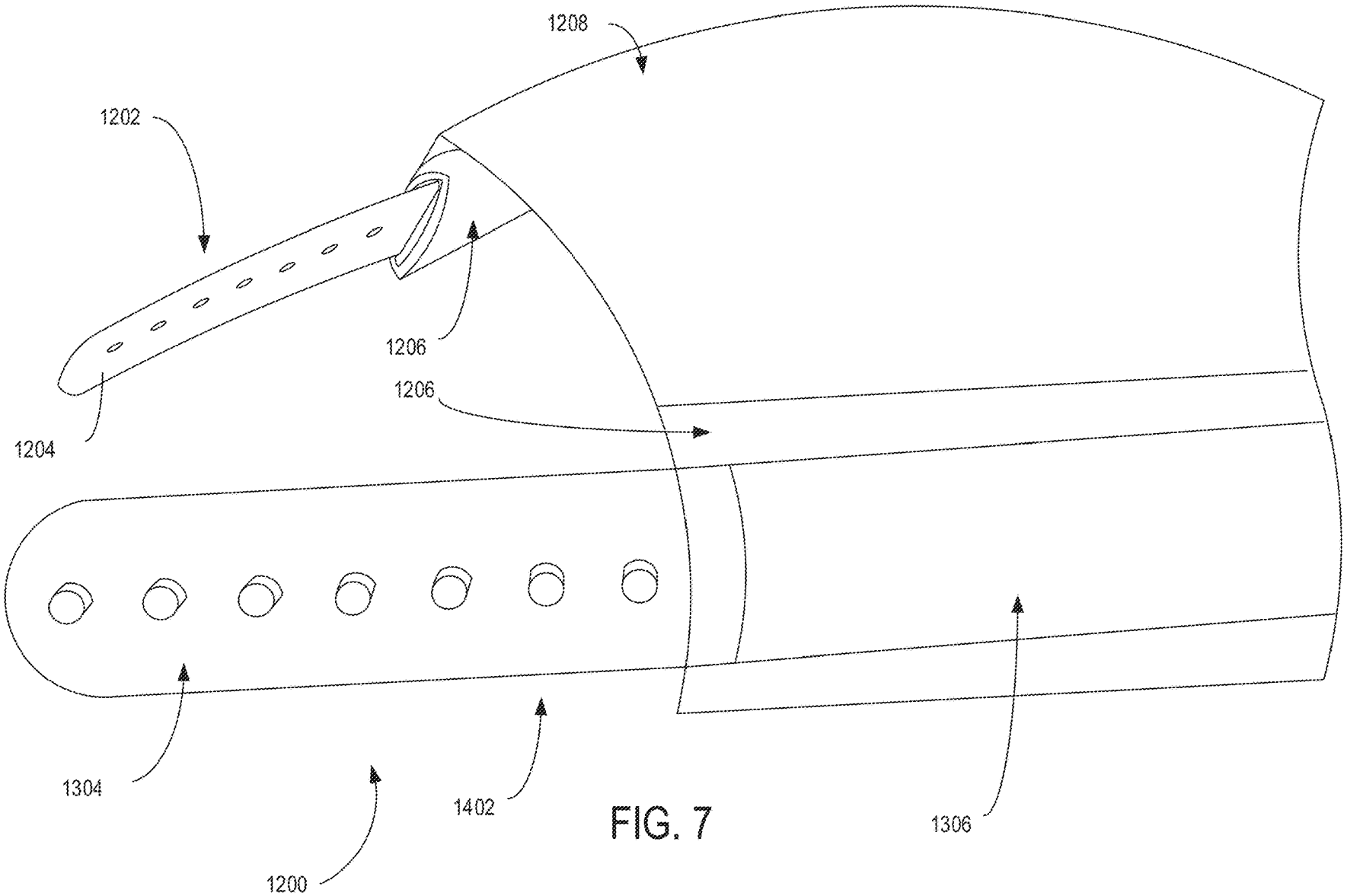
FIG. 7 shows an unextended elastic portion of a tab of an example snapback mechanism in accordance with one or more embodiments of the present disclosure.

FIG. 7 shows an example snapback mechanism 1200 including elastic portions disposed in a pocket between a headband/sweatband and an exterior of a crown of a hat. FIG. 7 shows an interior view of a first tab 1202 of the example snapback mechanism 1200. In FIG. 7, a rear view of a rigid portion 1204 of the first tab 1202 is illustrated as extending past a terminal end of a headband/sweatband 1206 and an edge of crown 1208. In the illustrated example, the rigid portion 1204 extends partly between a pocket formed between the crown 1208 and the headband/sweatband 1206.

In an unextended state, an elastic portion of the first tab 1202 may be housed between the crown 1208 and the headband/sweatband 1206. In the illustrated example, the elastic portion does not extend past an edge of the crown 1208. The headband/sweatband 1206 may be attached to the crown 1208 along a bottom perimeter of the crown 1208 so as to create a pocket housing the elastic portion of the first tab 1202.

FIG. 7 also shows an unextended elastic portion of a second tab 1402 of the example snapback mechanism. The second tab 1402 includes a rigid portion 1304, which extends partly into a pocket formed between the headband/sweatband 1206 and the crown 1208 (e.g., at an opposite terminal end of the headband/sweatband than the first tab 1202). The second tab 1402 also includes an elastic portion 1306, which is fully housed in the pocket between the headband/sweatband 1206 and the crown 1208 in an unextended state. When force is applied to pull the elastic portion 1306 of the second tab 1402, the elastic portion may extend beyond an edge of the crown 1208 and outside of the pocket formed between the headband/sweatband 1206 and the crown 1208.

The example elastic snapback mechanisms disclosed herein provide an increased granularity to the available sizes of headwear utilizing snapback mechanisms by allowing wearers to stretch the tabs of the snapback mechanism in order to achieve a comfortably snug fit along a sweatband of the headwear. Such modifications of the traditional snapback mechanism preserve the overall ease of use, adjustability, and appearance of that headwear adjustment mechanism while providing the comfort of an elastic headband.

The above examples largely incorporate snapback adjustable sizing mechanisms for hats. However, it is to be understood that the elastic adjustment mechanisms described therein may be applied to any other suitable adjustable sizing mechanism. FIGS. 8A-11C provide example alternative elastic adjustment mechanisms that may include elastic features as described above and below. In each example, one or more ends of the sizing mechanism may be provided with an elastic overmold, which includes an elastic material overmolded over a rigid or less elastic material (e.g., a material having a lower elasticity than the elastic material). In this way, the elastic material provides for comfort and fine adjustment of the mechanism, while the rigid or less elastic material provides for anchoring, guiding, and/or strengthening the mechanism.

Figure 8A:
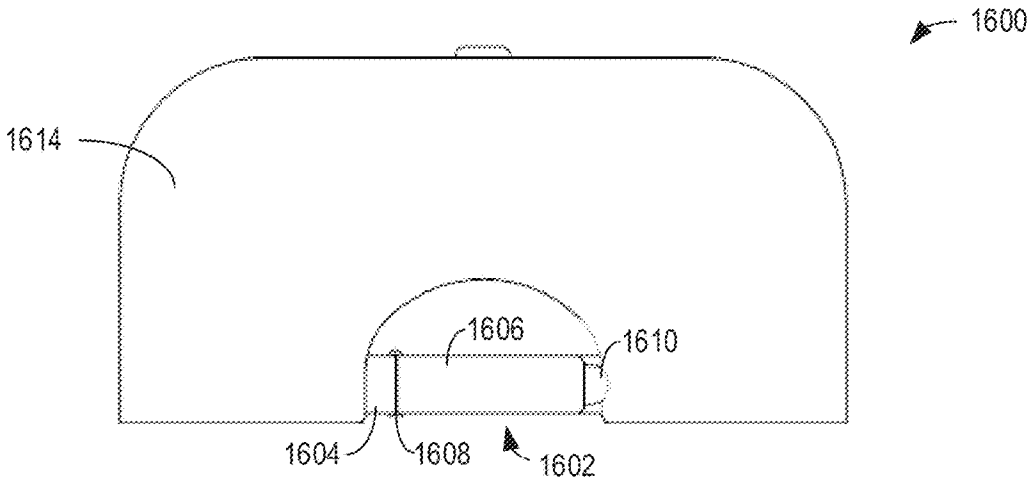
FIGS. 8A-8C show example pullable tab elastic adjustment mechanisms in accordance with one or more embodiments of the present disclosure.
Figure 8B:
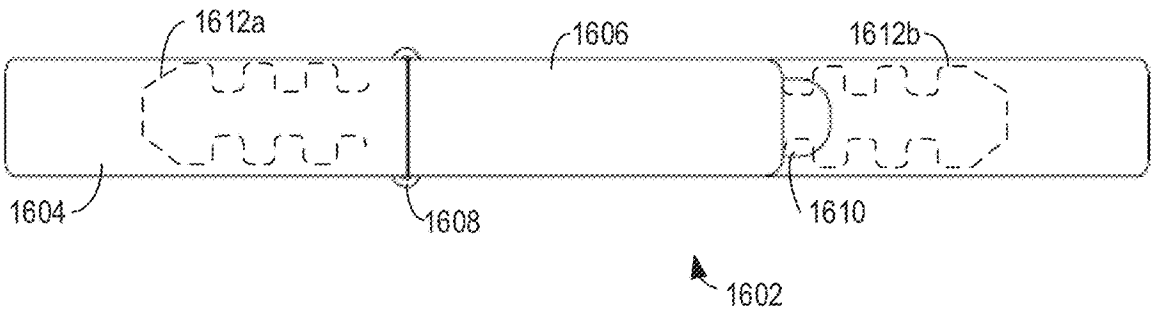
Figure 8C:
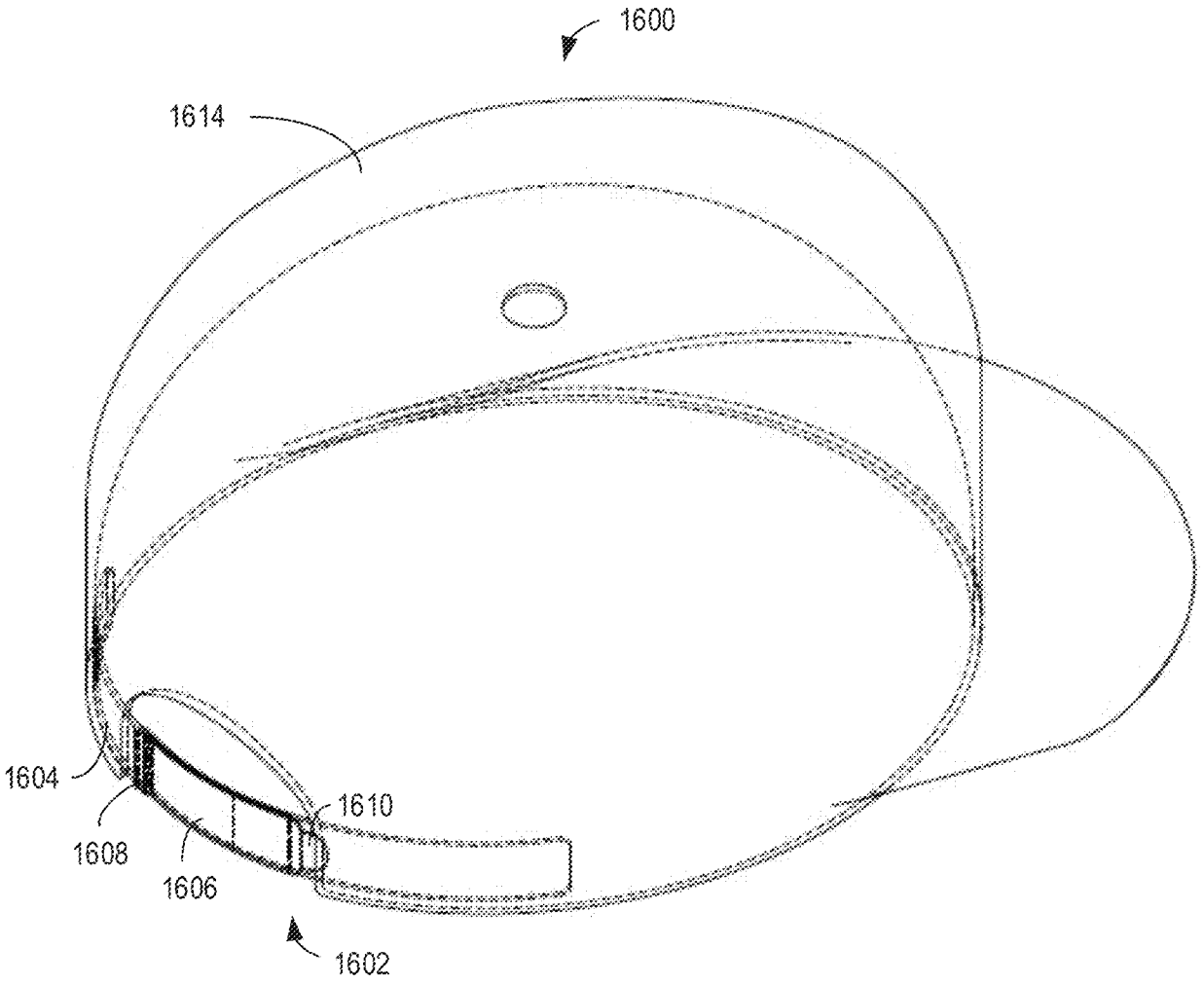

FIGS. 8A-8C show example pullable tab elastic adjustment mechanisms. FIG. 8A is a rear view of an example headwear, such as a hat 1600 including a pullable tab elastic adjustment mechanism 1602. The mechanism 1602 may be positioned similarly to the snapback mechanisms described above. For example, although shown substantially centered in the rear of the hat 1600, mechanism 1602 may be attached such that one or more tabs/straps extend toward a side of the hat (e.g., as shown in FIG. 6 with regards to the snapback mechanism). Mechanism 1602 may include a fixed strap 1604 and a pullable strap 1606, as well as a loop 1608. Fixed strap 1604 may be substantially fixed (e.g., attached via any suitable mechanism, such as glued, sewn, stapled, stitched, and/or otherwise secured) to the hat 1600 at a first end (e.g., secured to a headband of the hat) and coupled to the loop 1608 at a second end opposite the first end. In some examples, the fixed strap 1604 may be formed as a folded strap, such that one of two terminating ends of the folded strap (the two terminating ends being opposite one another along the longest dimension of the strap) is passed through the loop 1608 and the two terminating ends are fastened to the headband of the hat (e.g., in an interior of the hat).

Similarly to the fixed strap, the pullable strap 1606 may have two terminating ends (e.g., opposite one another along the longest dimension of the strap), one of which is substantially fixed (e.g., attached via any suitable mechanism, such as glued, sewn, stapled, stitched, and/or otherwise secured) to the hat on an opposite side of an opening in the crown 1614 from the attachment point of the fixed strap 1604. The other terminating end of the pullable strap 1606 (e.g., which is not fixed to the hat) may be passed through the loop 1608 and pulled to adjust a size of the hat. For example, all or a portion of the pullable strap 1606 may include hook and loop or other removable fastening material to allow one terminating end of the pullable strap to be pulled toward or away from the other terminating end to increase or decrease an overall/effective circumference of the headband. In other examples, the non-fixed terminating end of the pullable strap 1606 may include a button or other fastener that may be attached to one or more other points on the hat to maintain an adjusted circumference of the headband after pulling the non-fixed terminating end a desired extent. The pullable strap 1606 may include a tab 1610 to assist in pulling the non-fixed terminating end of the strap.

FIG. 8B is a detailed view of the adjustment mechanism 1602. As illustrated, the adjustment mechanism further includes spines 1612*a* and 1612*b*. The illustrated shape of the spines is exemplary, as any suitable rigid or semi-rigid structure overmolded with an elastic material (e.g., a material more elastic than the spine) may be utilized as the spine. For example, one or both of the straps 1604 and 1606 may include an elastic overmold such that elastic material is chemically and mechanically coupled (e.g., bound) to the associated spine. The spines 1612*a* and/or 1612*b* may provide a rigid structure to assist the associated strap with maintaining a desired shape and provide strength as the straps are adjusted to change a size of the hat. The spines may also guide movement of the straps in the longitudinal direction when pulled in order to prevent twisting of the straps. In some examples, one or both of the straps 1604 and 1606 may be attached to respective elastic straps overmolded over respective spines, such that the elastic straps permit additional movement of the one or both straps 1604 and 1606. In such examples, the straps 1604 and/or 1606 may be attached to the hat via the additional elastic straps. In other examples, the straps 1604 and/or 1606 may be attached directly to the hat and via the additional elastic straps in a reinforced manner.

Although a single spine is illustrated in each of fixed strap 1604 and pullable strap 1606, it is to be understood that one or more spines may be included in one or both of the straps 1604 and 1606. For example, a single spine may be included in fixed strap 1604 and no spine may be included in pullable strap 1606 or vice versa. In other examples, one or both straps may include multiple spines. The spines may be positioned in any suitable location and extend for any suitable length to provide the structural support described above. In some examples, spines 1612*a* and 1612*b* may correspond to rigid spines 408*a* and 408*b* of FIG. 2. Accordingly, spines 1612*a* and 1612*b* may include any one or more of the features of rigid spines 408*a* and 408*b* described above with respect to FIG. 2. FIG. 8C shows an isometric view of hat 1600. One or both straps may include the same material as the crown of the hat (e.g., as an outer covering; other material, such as a hook and loop material for pullable strap, may be used for an interior region of the strap).

Figure 9A:
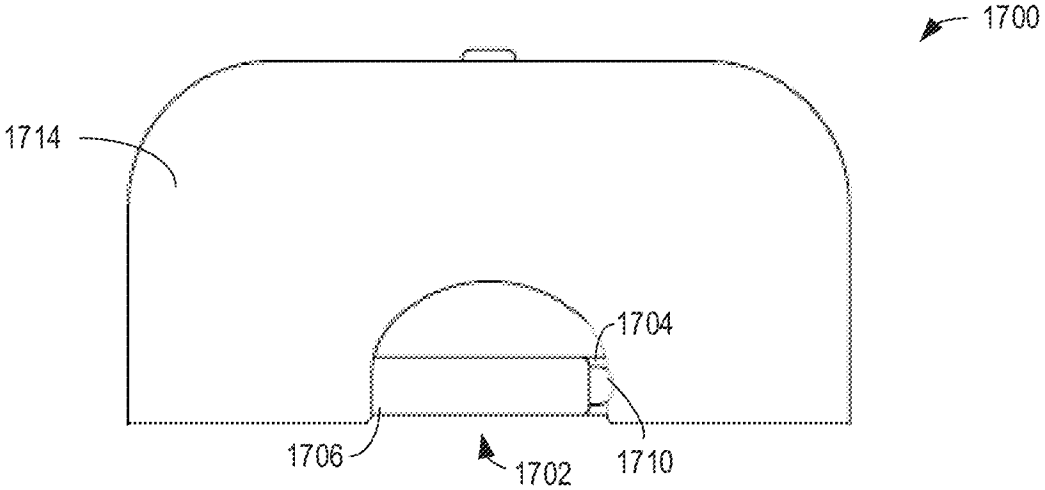
FIGS. 9A-9C show example hook and loop elastic adjustment mechanisms in accordance with one or more embodiments of the present disclosure.
Figure 9B:
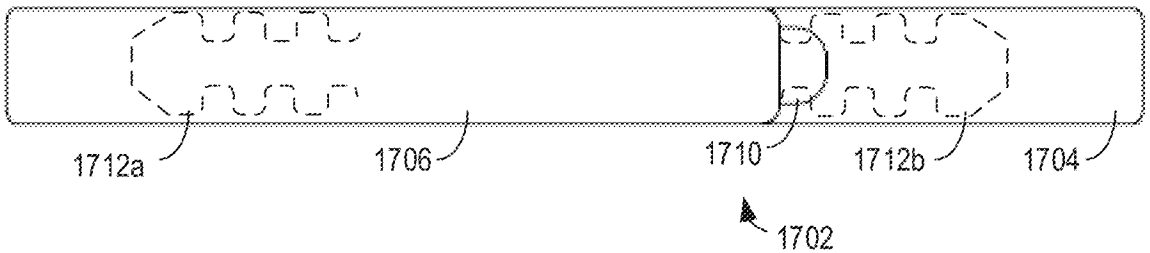
Figure 9C:
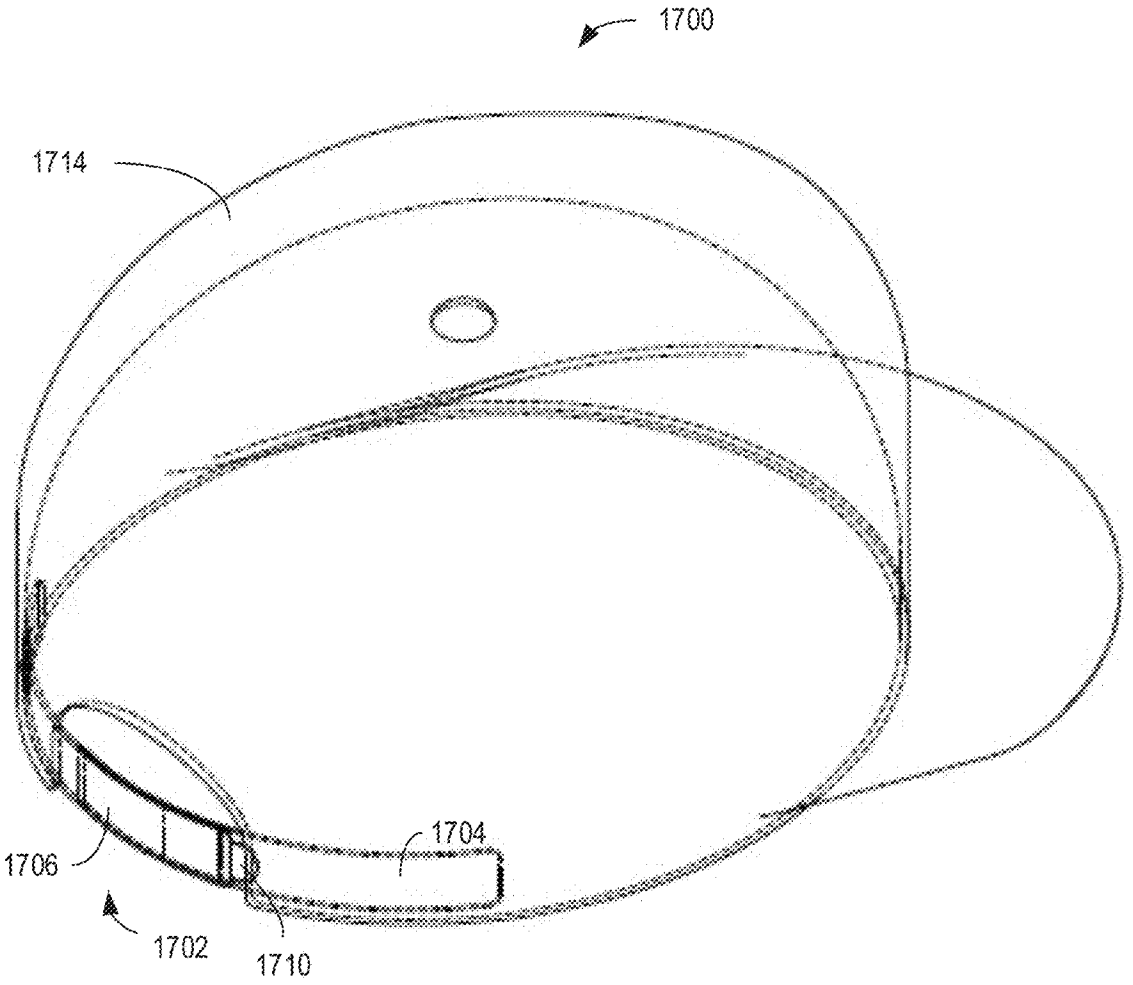

FIGS. 9A-9C show example hook and loop elastic adjustment mechanisms in accordance with one or more embodiments of the present disclosure. FIG. 9A is a rear view of a hat 1700 including a hook and loop elastic adjustment mechanism 1702. The mechanism 1702 may be positioned similarly to the snapback mechanisms described above. For example, although shown substantially centered in the rear of the hat 1700, mechanism 1702 may be attached such that one or more tabs/straps extend toward a side of the hat (e.g., as shown in FIG. 6 with regards to the snapback mechanism). Mechanism 1702 may include a fixed strap 1704 and a pullable strap 1706. Fixed strap 1704 may be substantially fixed (e.g., attached via any suitable mechanism, such as glued, sewn, stapled, stitched, and/or otherwise secured) to the hat 1700 at a first end (e.g., secured to a headband of the hat) and free (in an unfastened condition) or attached to the pullable strap 1706 (in a fastened condition) at a second end opposite the first end. The pullable strap 1706 may be arranged similarly to the fixed strap 1704 (e.g., fixed to the hat at one end and free/fixed to the fixed strap 1704 at an opposite end), and may include a tab 1710 to facilitate adjustment of the strap (e.g., pulling it toward the fixed end of the fixed strap 1704 to tighten the hat). An interior surface of the pullable strap 1706 may be configured to be in face-sharing contact with an exterior surface of the fixed strap 1704 to maintain a desired headband circumference (e.g., to change a distance between regions of the headband that terminate at an opening of crown 1714 of hat 1700). Accordingly, the interior surface of the pullable strap and the exterior surface of the fixed strap may include hook and loop material (e.g., one surface including hook material and one surface including loop material). It is to be understood that other fastening mechanisms may be used, such as buttons, adhesive, and/or other suitable fasteners in order to join the surfaces together.

Similarly to the pullable strap adjustment mechanism described above with respect to FIGS. 8A-8C, one or both of the straps 1704 and 1706 may include elastic material overmolded over rigid or semi-rigid spines 1712*a*/1712*b*, as illustrated in FIG. 9B. FIG. 9C shows an isometric view of hat 1700. One or both straps may include the same material as the crown of the hat (e.g., as an outer/inner covering; other material, such as a hook and loop material, may be used for an interior/exterior region of the strap).

Figure 10A:
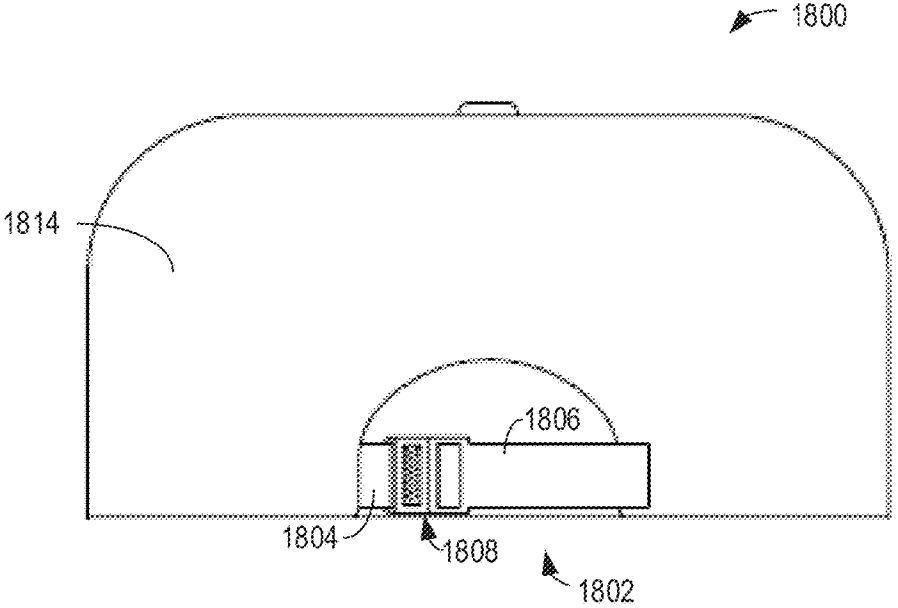
FIGS. 10A-10C show example buckle elastic adjustment mechanisms in accordance with one or more embodiments of the present disclosure.
Figure 10B:
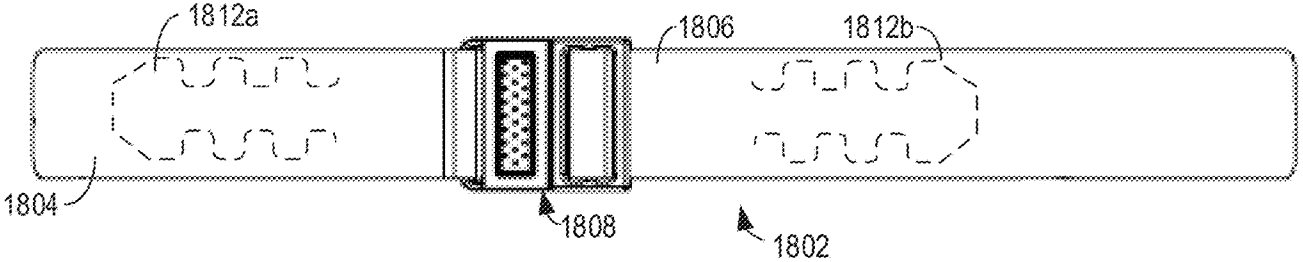
Figure 10C:
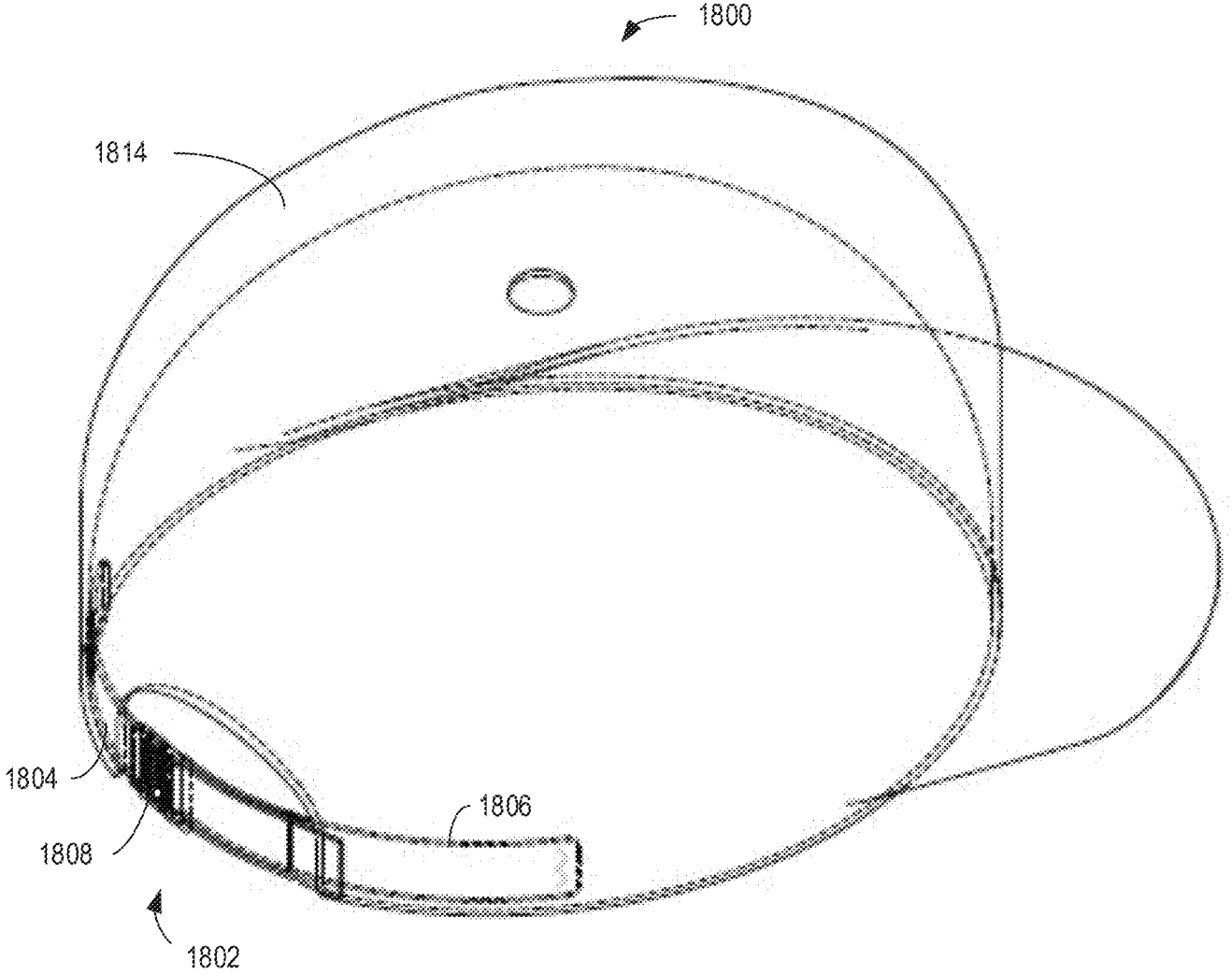

FIGS. 10A-10C show example buckle elastic adjustment mechanisms in accordance with one or more embodiments of the present disclosure. FIG. 10A is a rear view of a hat 1800 including a buckle elastic adjustment mechanism 1802. The mechanism 1802 may be positioned similarly to the snapback mechanisms described above. For example, although shown substantially centered in the rear of the hat 1800, mechanism 1802 may be attached such that one or more tabs/straps extend toward a side of the hat (e.g., as shown in FIG. 6 with regards to the snapback mechanism). Mechanism 1802 may include a fixed strap 1804 and a pullable strap 1806. Fixed strap 1804 may be substantially fixed (e.g., attached via any suitable mechanism, such as glued, sewn, stapled, stitched, and/or otherwise secured) to the hat 1800 at a first end (e.g., secured to a headband of the hat) and free (in an unfastened condition) or attached to the pullable strap 1806 (in a fastened condition) at a second end opposite the first end. The pullable strap 1806 may be arranged similarly to the fixed strap 1804 (e.g., fixed to the hat at one end and free/fixed to the fixed strap 1804 at another part of the strap). Each of the fixed strap 1804 and the pullable strap 1806 may include a portion of a buckle 1808 (e.g., at a terminating end of the fixed strap 1804 and along the length of the pullable strap 1806, respectively). The portions of the buckle on each strap may be configured to connect to one another in a fastened condition, as illustrated in FIG. 10A. The portion of the buckle 1808 included in the pullable strap 1806 may include a loop through which a terminating end of the pullable strap 1806 may be passed and pulled to tighten the hat (e.g., to change a circumference of the headband of the hat by changing a distance between regions of the headband that terminate at an opening of crown 1814 of hat 1800).

Similarly to the pullable strap adjustment mechanism described above with respect to FIGS. 8A-8C, one or both of the straps 1804 and 1806 may include elastic material overmolded over rigid or semi-rigid spines 1812*a*/1812*b*, as illustrated in FIG. 10B. FIG. 10C shows an isometric view of hat 1800.

Figure 11A:
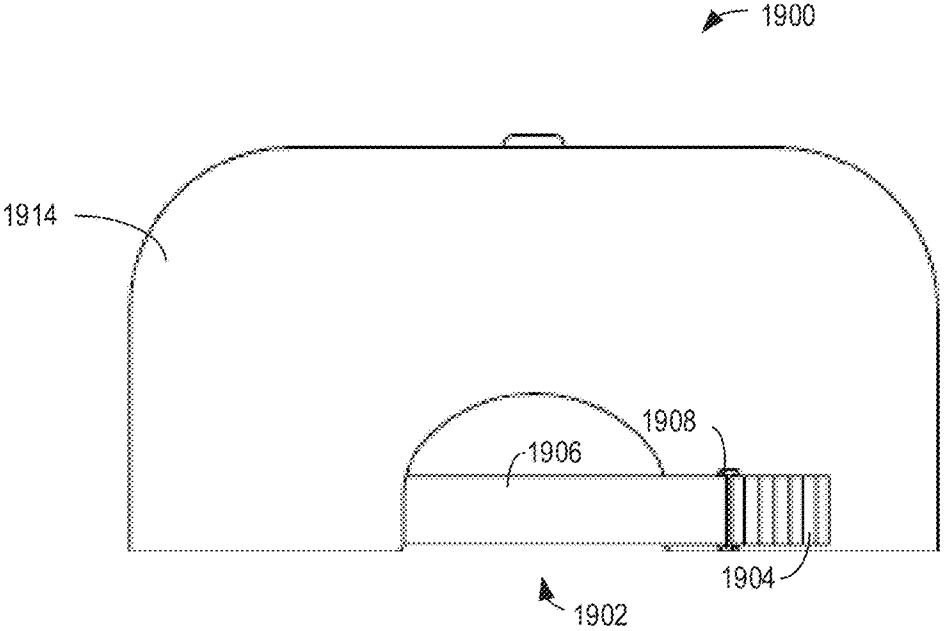
FIGS. 11A-11C show example ballistic elastic adjustment mechanisms in accordance with one or more embodiments of the present disclosure.
Figure 11B:
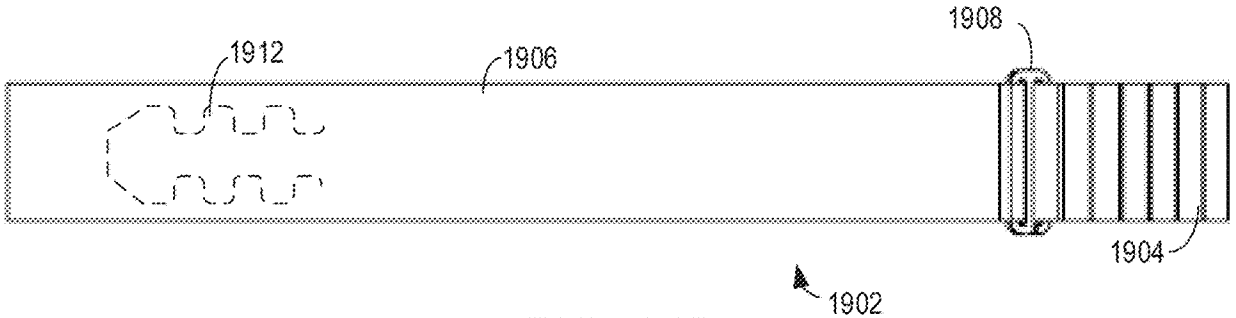
Figure 11C:
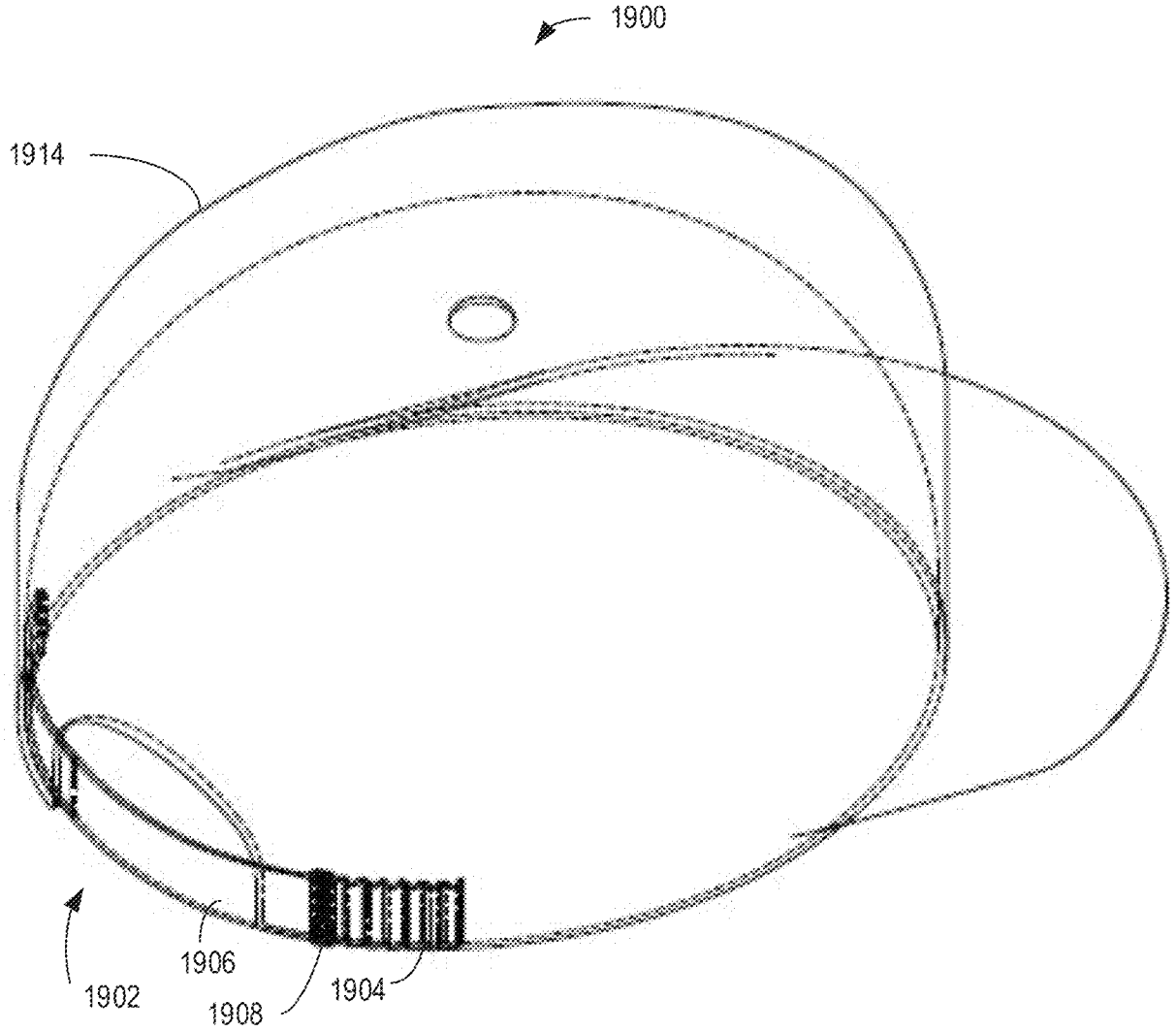

FIGS. 11A-11C show example ballistic elastic adjustment mechanisms in accordance with one or more embodiments of the present disclosure. FIG. 11A is a rear view of a hat 1900 including a ballistic elastic adjustment mechanism 1902. The mechanism 1902 may be positioned similarly to the snapback mechanisms described above. For example, although shown substantially centered in the rear of the hat 1900, mechanism 1902 may be attached such that one or more tabs/straps extend toward a side of the hat (e.g., as shown in FIG. 6 with regards to the snapback mechanism). Mechanism 1902 may include a fixed loop structure 1904 and a pullable strap 1906. Fixed loop structure 1904 may be substantially fixed (e.g., attached via any suitable mechanism, such as glued, sewn, stapled, stitched, and/or otherwise secured) to the hat 1900 to provide a series of loops that may accept a hook 1908 disposed on the pullable strap 1906. The pullable strap 1906 may be fixed to the hat at one end and free (in an unfastened condition) or fixed (in a fastened condition) to the fixed loop structure 1904 at another part of the strap. The pullable strap 1906 may be pulled toward the fixed loop structure 1904 and the hook inserted into a selected loop of the fixed loop structure to tighten the hat (e.g., to change a circumference of the headband of the hat by changing a distance between regions of the headband that terminate at an opening of crown 1914 of hat 1900).

Similarly to the pullable strap adjustment mechanism described above with respect to FIGS. 8A-8C, the pullable strap 1906 may include elastic material overmolded over one or more rigid or semi-rigid spines 1912, as illustrated in FIG. 11B. FIG. 11C shows an isometric view of hat 1900.

Figure 12A:
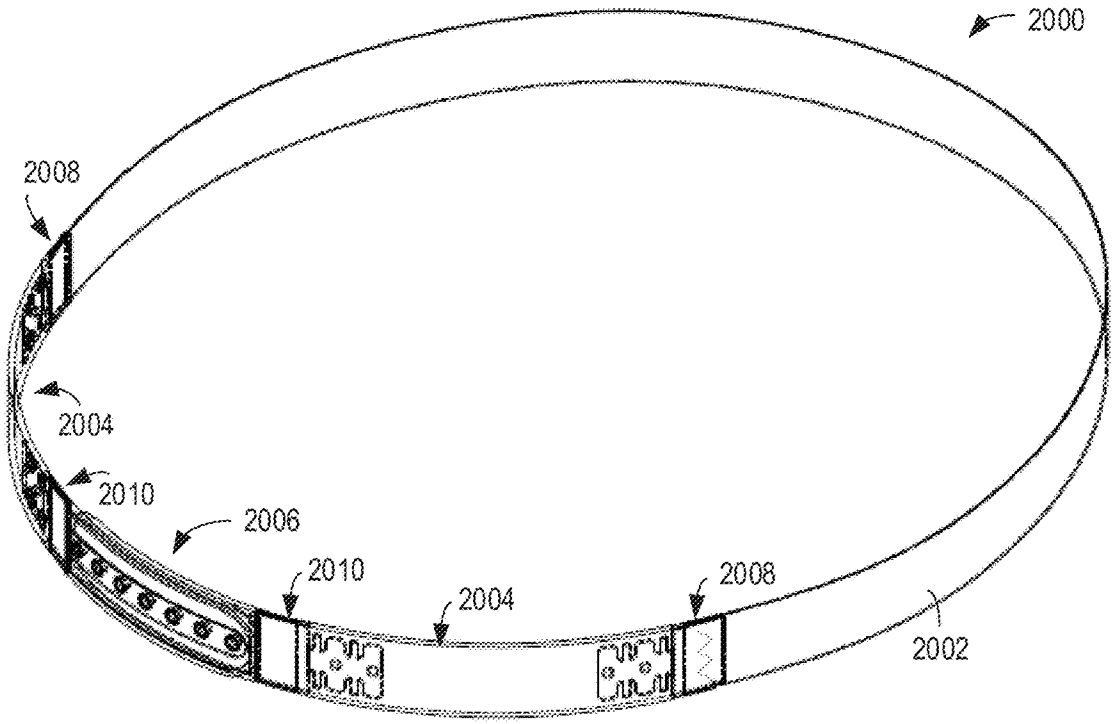
FIGS. 12A and 12B show different views of an example headband including an elastic sizing adjustment mechanism in accordance with one or more embodiments of the present disclosure.
Figure 12B:
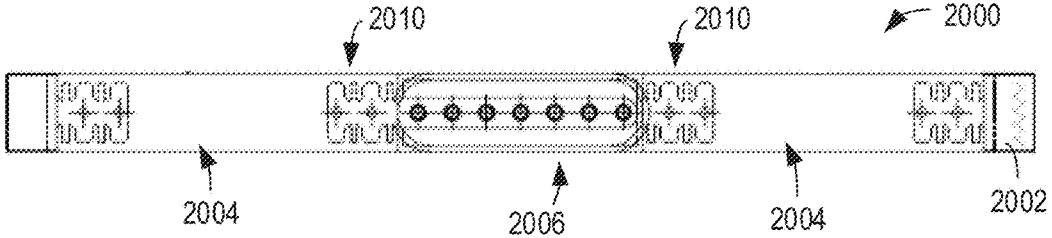

FIGS. 12A and 12B show different views of an example headband 2000 including an elastic sizing adjustment mechanism 2006. FIG. 12A shows an isometric view of the headband 2000. The headband 2000 may include any combination of components and materials to form an adjustable crown-sizing feature of a hat. For example, headband 2000 may include a sweatband 2002, having two terminating ends that are each attached to a respective strap 2004 (e.g., via a flange, as described in more detail below with respect to FIGS. 15-17). The straps 2004 may be further attached to a sizing mechanism 2006. The illustrated example shows a snap-back sizing mechanism, such as that described in FIGS. 2-4B, but it is to be understood that any suitable sizing mechanism may be incorporated in the headband 2000, including but not limited to those described above with respect to FIGS. 8A-11C. Although shown as single elements, it is to be understood that sweatband 2002 and straps 2004 may include multiple sections and/or may be formed of composite materials. In some examples, sweatband 2002 may not extend fully between straps 2004, but rather may include two or more sweatband sections that are attached to an interior of a crown of a hat. It is to be understood that headband 2000 may be incorporated into any suitable hat, including but not limited to those specifically described herein.

As illustrated in FIG. 12A, sweatband 2002 may be attached to strap 2004 at one or more attachment points 2008. The attachment points 2008 may include any suitable fastening mechanism, including but not limited to those specifically described herein. For example, as described in more detail below, a terminating end of sweatband 2002 may be inserted into a slot formed between outer and inner surfaces of a terminating end of strap 2004 and stitching may be passed from the outer surface of the terminating end of the strap, through the sweatband, and through the inner surface of the terminating end of the strap to secure the sweatband in the slot. In other examples, the slot may be lined with glue or other adhesives to secure the sweatband therein. In still other examples, the sweatband may be mechanically secured in the slot (e.g., mechanically clamped, such that protruding features within the slot are pressed through the sweatband).

The straps may be attached at an opposite terminating end (e.g., opposite to the terminating end that is attached to the sweatband) to a rigid structure and/or other feature of sizing mechanism 2006. The straps 2004 may be attached to the sizing mechanism 2006 in any suitable manner, including but not limited to those described above with respect to attaching the straps to the sweatband. In some examples, the same mechanism may be used to attach the strap to both the sweatband and the sizing mechanism. In other examples, different mechanisms may be used to attach the straps to the sweatband and the sizing mechanism. FIG. 12B shows a front view of headband 2000, including attachment points 2010 at which the straps 2004 are attached to the sizing mechanism 2006.

Figure 13:
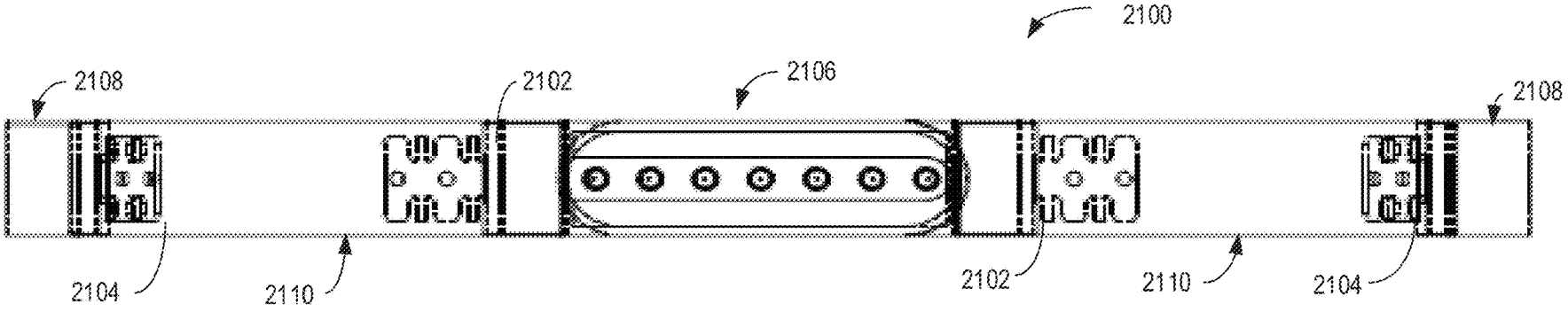
FIG. 13 shows an example view of overmolding within an example headband including an elastic sizing adjustment mechanism in accordance with one or more embodiments of the present disclosure.

FIG. 13 shows an example view of overmolding within an example headband 2100 of a hat. For example, spine structures 2102 and 2104, which may be formed similarly to rigid spines 408*a* and 408*b* of FIG. 2, may extend from tabs of a sizing mechanism 2106 and attachment points 2108, respectively. Straps 2110 may include elastomeric material overmolded over the spine structures 2102 and 2104 to form an elastic copolymer overmold.

Attachment points 2108 may connect the sizing mechanism 2106 (e.g., via straps 2110) to a region of a hat (e.g., a sweatband of a hat or other material in a perimeter portion of a crown of the hat), which may be formed of any suitable material. As discussed above with respect to rigid spines 408*a* and 408*b*, the overmolding may promote structural integrity near points of attachment to control a direction of elastic stretching and retain a shape of the headband.

Figure 14:
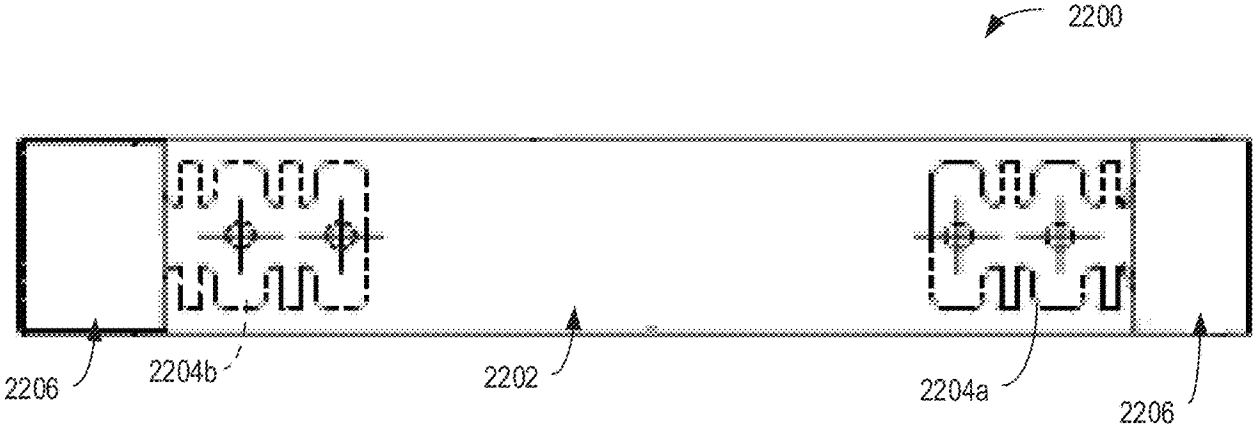
FIG. 14 shows an example detail view of overmolding within an example elastic member in accordance with one or more embodiments of the present disclosure.

FIG. 14 shows an example detail view of overmolding within an example elastic member 2200. Elastic member 2200 may include an elastomeric strap 2202 including one or more spine structures 2204*a* and optionally 2204*b* extending from attachment points 2206. As shown by the dashed lines, spine structure 2204*b* is optional and may be omitted in examples where only one end of the elastic member 2200 is to be reinforced. For example, the terminating end at attachment points 2206 of the elastic member that is closest to spine structure 2204 may be attached to a sizing mechanism, while the other terminating end at attachment point 2206 may be attached to a sweatband of a hat or may extend continuously around a perimeter of the hat in order to allow the elastic member 2200 itself to serve as the sweatband of the hat. In this example, spine structure 2204*b* may not be included, and the elastic member 2200 may only include one spine structure. In other examples, where reinforcement at both terminating ends is used, the elastic member 2200 may include both spine structures 2204*a* and 2204*b* near opposing terminating ends of the elastic member. In still other examples, one or more spine structures may be disposed at any suitable location(s) along the length of the elastic member 2200. The above-described elements of elastic member 2200 may be similar to the likewise-named elements of headband 2100, and the above-description of such elements may thereby apply to elastomeric strap 2202, spine structures 2204, and attachment points 2206. As illustrated in FIG. 14, in some examples, strap 2202 may extend from one attachment point to another, without including a specific sizing mechanism there between. Strap 2202 may enable any two structures to be attached to one another via an elastic intermediary element by attaching to the two structures at respective attachment points 2206. Accordingly, elastic member 2200 may be coupled to a sizing mechanism at one terminating end (e.g., via one attachment point 2206) and a headband or other hat feature at an opposite terminating end (e.g., via the other attachment point 2206). In another example, two sections of a headband may be attached to one another via the elastic member 2200. The above examples are non-limiting, and any two elements may be joined via elastic member 2200 to allow the two elements to be elastically coupled to one another.

Figure 15:
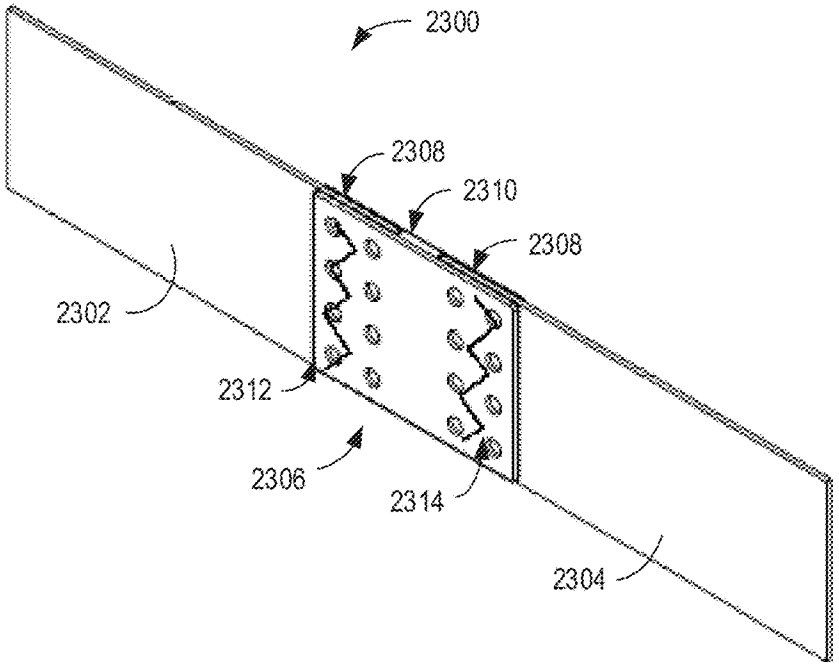
FIG. 15 shows a front isometric view of a band including an example double-sided sew flange in accordance with one or more embodiments of the present disclosure.

FIG. 15 shows a front isometric view of an example band 2300 including a double-sided sew flange for an elastic sizing mechanism or other suitable structure having multiple elements that are to be joined together. Band 2300 may include a first band section 2302 joined to a second band section 2304 via a double-sided sew flange 2306. The first and second band sections 2302 and 2304 may include any suitable material or combination of materials. In one example, band section 2302 may include a terminating end of a sizing mechanism, which may be rigid or semi-rigid in some examples, and band section 2304 may include a terminating end of a headband of a hat. Flange 2306 includes a pair of slots 2308 with a buffer element 2310 disposed there between. A terminating end of each of the band sections 2302 and 2304 may be inserted into a respective slot 2308 (e.g., to a maximum depth that corresponds to contacting the buffer 2310).

Stitching 2312 and/or any other suitable securing/fastening mechanism may be utilized to secure/fasten the band sections within the respective slots. For example, the stitching may pass through holes 2314 and through the band sections to secure the band sections within the slot. In other examples, holes 2314 may represent a secondary securing mechanism (e.g., bolts/tacks or similar structures may be passed through the holes and the band sections to the other side of the flange). The holes 2314 may additionally or alternatively serve as indicators to guide insertion of stitches and/or other fastening mechanisms. In some examples, the flange 2306 may be at least semi-rigid to provide structural support for the band sections. In such examples, the flange 2306 may also be semi-flexible to promote comfort (e.g., when the flange is used to join material in a garment, such as a headband of a hat) and durability (e.g., to allow some give while the band sections move relative to one another).

Figure 16:
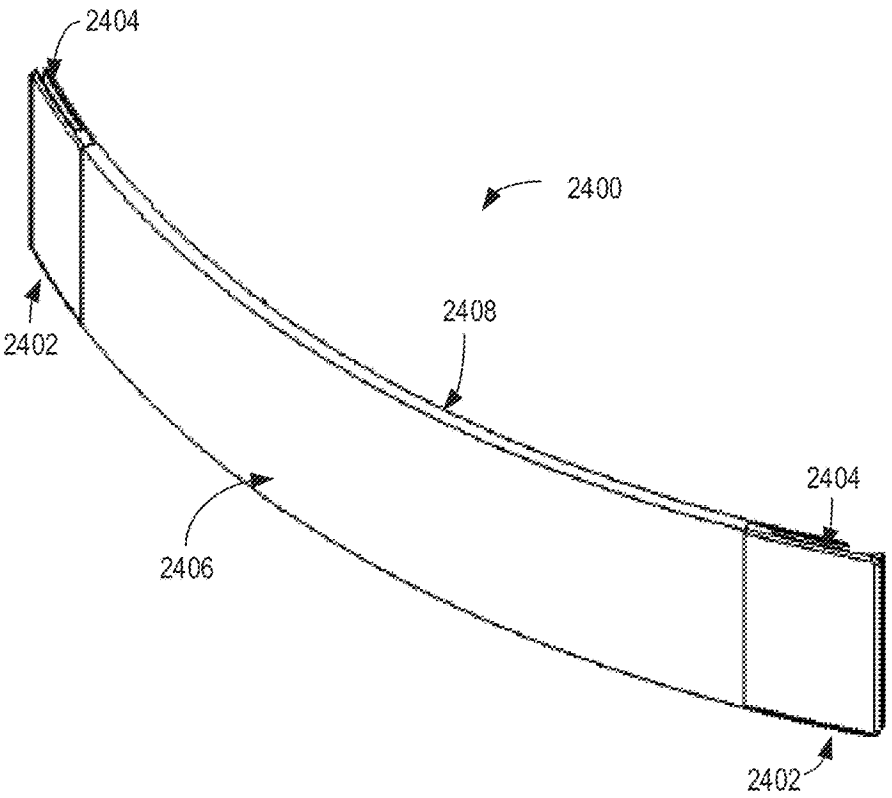
FIG. 16 shows an example long double-sided sew flange in accordance with one or more embodiments of the present disclosure.

FIG. 16 shows an example detail view of a long double-sided sew flange 2400 for an elastic sizing mechanism or other suitable structure having multiple elements that are to be joined together. As illustrated, flange 2400 may include two terminating ends 2402 that include slots 2404 formed within an opening between a front surface 2406 and a rear surface 2408 of the flange 2400. As described above with respect to FIGS. 12A-15, two pieces of material that are to be joined may each be inserted into respective slots. In some examples, stitching, clamping, or other fastening mechanisms may be used to secure the material within the slots. Additionally or alternatively, the material may be secured within the slots due to a texture pattern of an interior of the slots and/or adhesive material disposed within and/or around the slots. The slots may form an "H" bracket or coupler and may include indicators for guiding application of stitching, clamping, or other fastening mechanisms.

Figure 17:
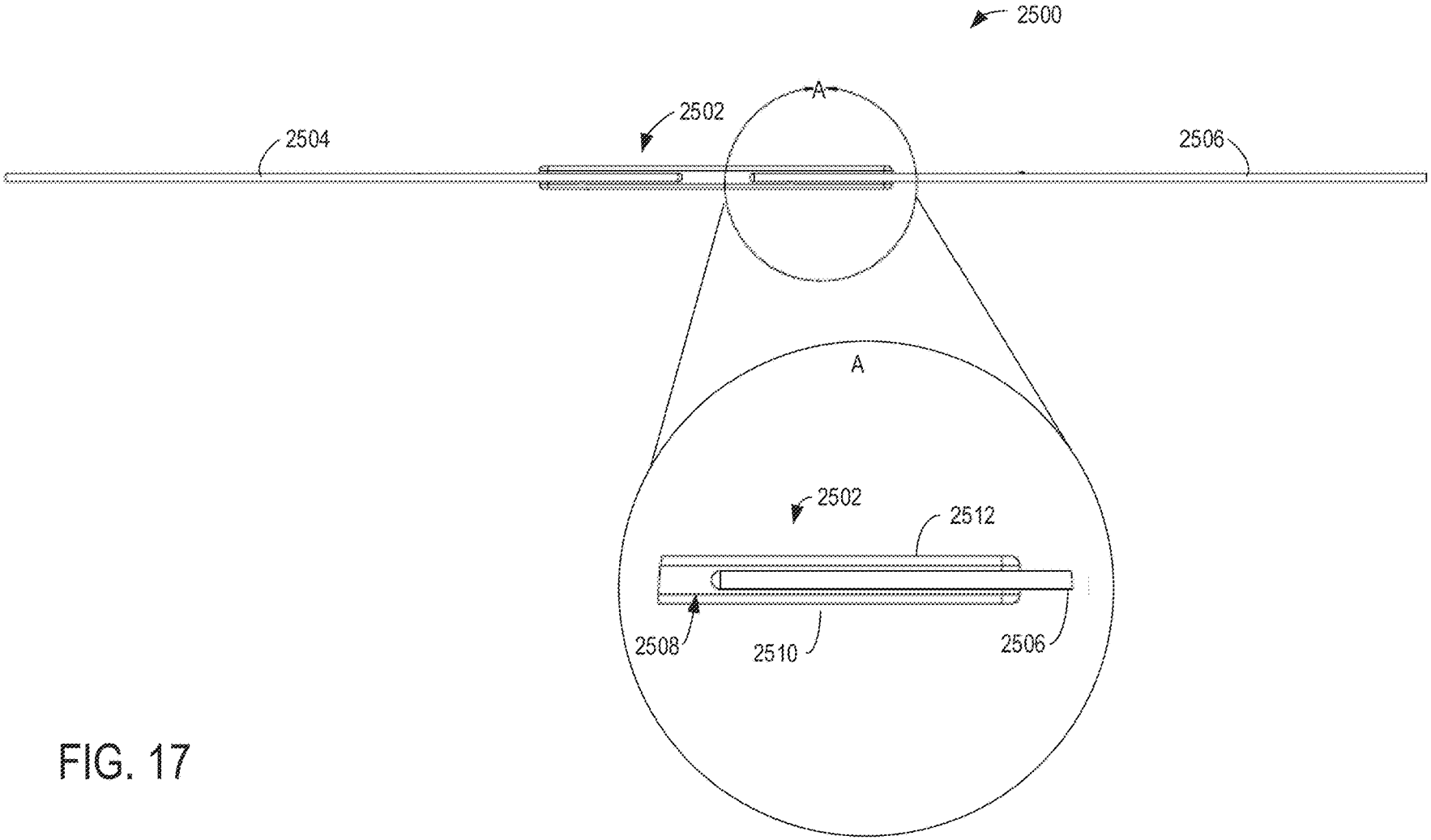
FIG. 17 shows an example headband of a hat including a double-sided sew flange in accordance with one or more embodiments of the present disclosure.

FIG. 17 shows an example headband 2500 of a hat including a double-sided sew flange 2502 coupling a first material 2504 to a second material 2506. As described above, the two joined materials 2504 and 2506 may comprise any suitable material, and may include material of a sizing mechanism and a headband, respectively, in some examples. Detail A of FIG. 17 shows a close-up view of a slot 2508 of flange 2502. As shown, a terminating end of each of the front surface 2510 and rear surface 2512 of the flange 2502 may be rounded in order to provide a gradual transition between the flange and the material 2506. As shown, there may be a gap between the material 2506 and one or more regions of the interior of the slot. The gap may be filled with an adhesive and/or mechanically closed over the material by way of stitching, clamping, etc. In other examples, the gap (e.g., a gap between the two sections of material 2504 and 2506) may be maintained to allow additional stretching/movement during use. The size of the slot (e.g., the width, height, thickness, etc.) may be based on the material being inserted therein and/or may be a function of the overall width/height/thickness of the flange. Example dimensions of the flange may include ¾" high (e.g., from a bottom to a top), 1-1.5" wide (e.g., between terminating ends and/or between slot openings), with a slot opening that measures $^{25}/_{1000}$" between interiors of the front and rear surfaces of the terminating ends of the flange. It is to be understood that these measurements are exemplary in nature, and any suitable dimensions may be utilized. The flange may be made of any suitable material, including but not limited to polypropylene, nylon, polyethylene, and/or other soft-durable material.

In some examples, the flange may be a part of a kit or assembly for adapting a hat with an elastic sizing mechanism. For example, the kit or assembly may include the flange and one or both materials inserted therein. The material(s) may be attached to existing features of the hat to adapt the hat. For example, the material(s) may include a sizing mechanism and/or an elastomeric strap. Attaching these materials to one another and the hat via the flange enables the hat to be easily adapted to include an elastic sizing mechanism. In some examples, the flange itself may be formed of elastomeric material. In such examples, the flange may be attached to a rigid portion of a sizing mechanism via one slot and to a headband of a hat via another slot, the flange providing additional flexibility when using the sizing mechanism.

The disclosure above also provides for headwear including a crown including a cap, and a size-adjusting mechanism extending around a portion of a perimeter of the cap and adapted to selectively adjust a size of the cap, the size-adjusting mechanism comprising a first tab including a plurality of holes, and a second tab including a plurality of snaps configured to engage with the plurality of holes of the first tab, at least one of the first tab and the second tab being coupled to the perimeter of the cap via an elastic portion attached to a terminal end of a rigid portion of that tab. In a first example of the headwear, the headwear may include a visor extending from the cap and a headband extending around a portion of the perimeter of an interior of the cap and including terminating ends that are spaced from one another at an opening in a rear of the cap. A second example of the headwear optionally includes the first example, and further includes the headwear wherein the elastic portion of the first tab and/or the second tab is attached between the headband and the crown and wherein at least a portion of the elastic portion that is attached between the headband and the crown extends within a pocket formed between the headband and the crown. A third example of the headwear optionally includes one or more of the first and the second examples, and further includes the headwear wherein the elastic portion of the first tab and/or the second tab comprises an elastic strap extending from the terminal end of that tab to an attachment point on the perimeter of the cap, the attachment point for the elastic strap being positioned between an edge of the visor and an edge of the opening in the rear of the cap, the edge of the opening in the rear of the cap being on the same side of the cap as the edge of the visor. A fourth example of the headwear optionally includes one or more of the first through the third examples, and further includes the headwear wherein each of the first tab and the second tab is coupled to the perimeter of the cap via a respective elastic portion attached to a terminal end of the rigid portion of that tab. A fifth example of the headwear optionally includes one or more of the first through the fourth examples, and further includes the headwear wherein the respective elastic portion of each of the first tab and the second tab is configured to extend along less than half of the circumference of the perimeter of the crown. A sixth example of the headwear optionally includes one or more of the first through the fifth examples, and further includes the headwear wherein a distance between the attachment point for the elastic strap of the first tab and a first edge of the opening in the rear of the cap is substantially equal to a distance between the attachment point for the elastic strap of the second tab and a second edge of the opening, the second edge of the opening being opposite from the first edge of the opening respective to a center of the opening. A seventh example of the headwear optionally includes one or more of the first through the sixth examples, and further includes the headwear wherein a distance between the attachment point for the elastic strap of the first tab and a first edge of the opening in the rear of the cap is different than a distance between the attachment point for the elastic strap of the second tab and a second edge of the opening, the second edge of the opening being opposite from the first edge of the opening respective to a center of the opening. An eighth example of the headwear optionally includes one or more of the first through the seventh examples, and further includes the headwear wherein the elastic portion of the first tab and/or the second tab is attached to a respective edge of the opening at an opposite end of the elastic portion than the rigid portion of that tab. A ninth example of the headwear optionally includes one or more of the first through the eighth examples, and further includes the headwear wherein the elastic portion of the first tab and/or the second tab is attached at two or more positions between an edge of the opening and an edge of the visor, the edge of the opening and the edge of the visor being on the same side of the headwear. A tenth example of the headwear optionally includes one or more of the first through the ninth examples, and further includes the headwear wherein the rigid portion of the first tab and/or the second tab is attached to one or more of the headband and the crown. An eleventh example of the headwear optionally includes one or more of the first through the tenth examples, and further includes the headwear wherein the elastic portion comprises an elastic strap encased in fabric and attached to at least one of the first tab and the second tab. A twelfth example of the headwear optionally includes one or more of the first through the eleventh examples, and further includes the headwear wherein the rigid portion of the first tab and/or the second tab comprises a first rigid portion, the first tab and/or the second tab further comprising a rigid spine encased in a portion of the elastic portion of the first tab and/or the second tab. A thirteenth example of the headwear optionally includes one or more of the first through the twelfth examples, and further includes the headwear wherein the rigid spine comprises a rectangular strip of rigid material having a plurality of protrusions spaced from one another and extending from the rectangular strip toward a bottom and a top of the headwear. A fourteenth example of the headwear optionally includes one or more of the first through the thirteenth examples, and further includes the headwear wherein the rigid spine extends from an attachment point of the first rigid portion of the first tab and/or the second tab to the elastic portion of the first tab and/or the second tab, and terminates prior to reaching an attachment point of the elastic portion of the first tab and/or the second tab to the cap.

The disclosure also provides for headwear including a crown including a cap, and a size-adjusting mechanism extending around only a portion of a perimeter of the cap and adapted to selectively adjust a size of the cap, the size-adjusting mechanism comprising a first tab including a plurality of holes, and a second tab including a plurality of snaps configured to engage with the plurality of holes of the first tab, each of the first tab and the second tab being coupled to the perimeter of the cap via an elastic portion attached to a terminal end of a rigid portion of that tab. A first example provides for the headwear wherein the elastic portion of the first tab and the second tab is configured to be more elastic in a direction extending along the perimeter of the cap than a direction extending from a bottom of the cap to a top of the cap.

The disclosure also provides for headwear including a crown including a cap; and a size-adjusting mechanism extending around only a portion of a perimeter of the cap and adapted to selectively adjust a size of the cap, the size-adjusting mechanism comprising one or more straps, at least one of the one or more straps being coupled to the perimeter of the cap via an elastic portion attached to a terminal end of a rigid portion of that strap or via an elastic portion integrated in that strap, the elastic portion comprising elastic material overmolded onto a rigid structure.

The disclosure also provides for a kit for elasticizing a sizing mechanism for headwear, the kit including a double-sided sew flange, the double-sided sew flange having two terminating ends opposite one another, each terminating end including a slot for inserting material, and a size-adjusting mechanism adapted to selectively adjust a size of the cap, the size-adjusting mechanism being coupled to a first terminating end of the two terminating ends of the double-sided sew flange via the slot of the first terminating end, at least one of the double-sided sew flange and the size-adjusting mechanism comprising elastomeric material. A first example of the kit optionally includes the kit wherein a second terminating end of the two terminating ends is coupled to a headband of the headwear. A second example of the kit optionally includes the first example and further includes the kit wherein the double-sided sew flange comprises an elastic copolymer overmold, the elastic copolymer overmold comprising elastic material overmolded onto a rigid structure. A third example of the kit optionally includes one or more of the first and the second examples and further includes an elastomeric strap coupled to or extending from the size-adjusting mechanism, wherein the size-adjusting mechanism is coupled to the first terminating end of the double-sided sew flange indirectly via the elastic strap, the elastic strap being attached to one of the two terminating ends of the double-sided sew flange.

FIGS. 18-21 show an example ballistic sizing mechanism. In some examples, the ballistic or bombardier sizing system may include webbing for sewn sizing loops on a side of the crown to provide a custom fit. The sizing system may be created with super tough woven webbing, metal retention clips that create a positive connection with sewn loops, and high quality elastic to ensure performance in any situation. An elastic webbing anchor may be used to allow a wearer to customize fit beyond pre-sized webbing loops. An absence of moving parts removes the possibility of breaking the sizing mechanism in the field.

Figure 18:
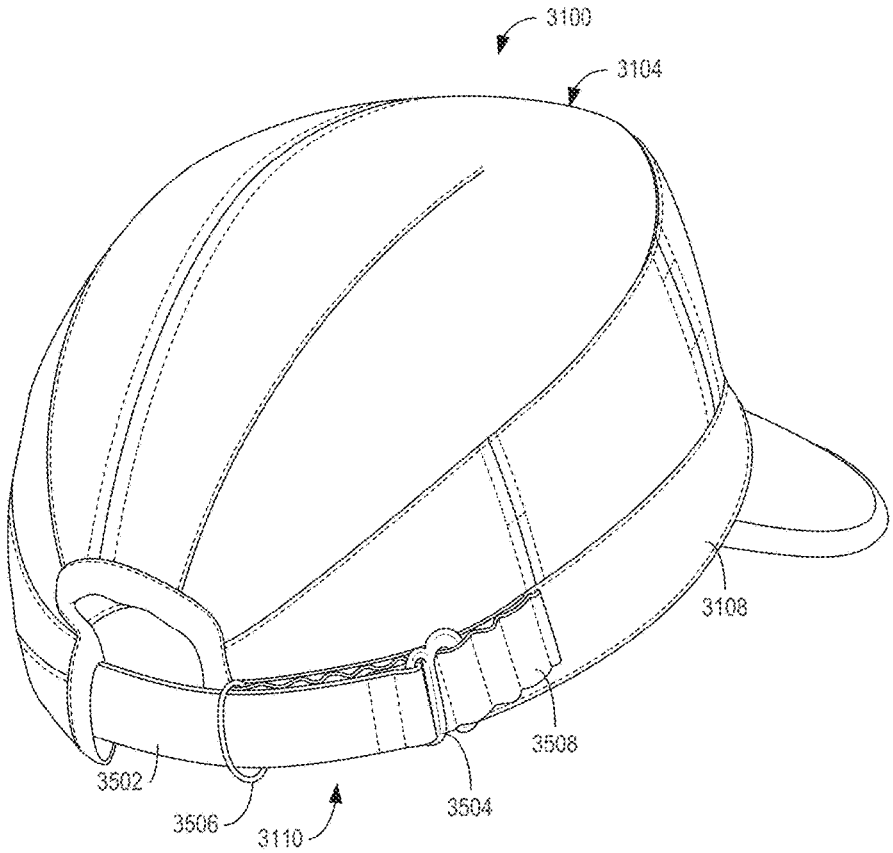
FIGS. 18 and 19 show rear views of an example headwear in accordance with one or more embodiments of the present disclosure.
Figure 19:
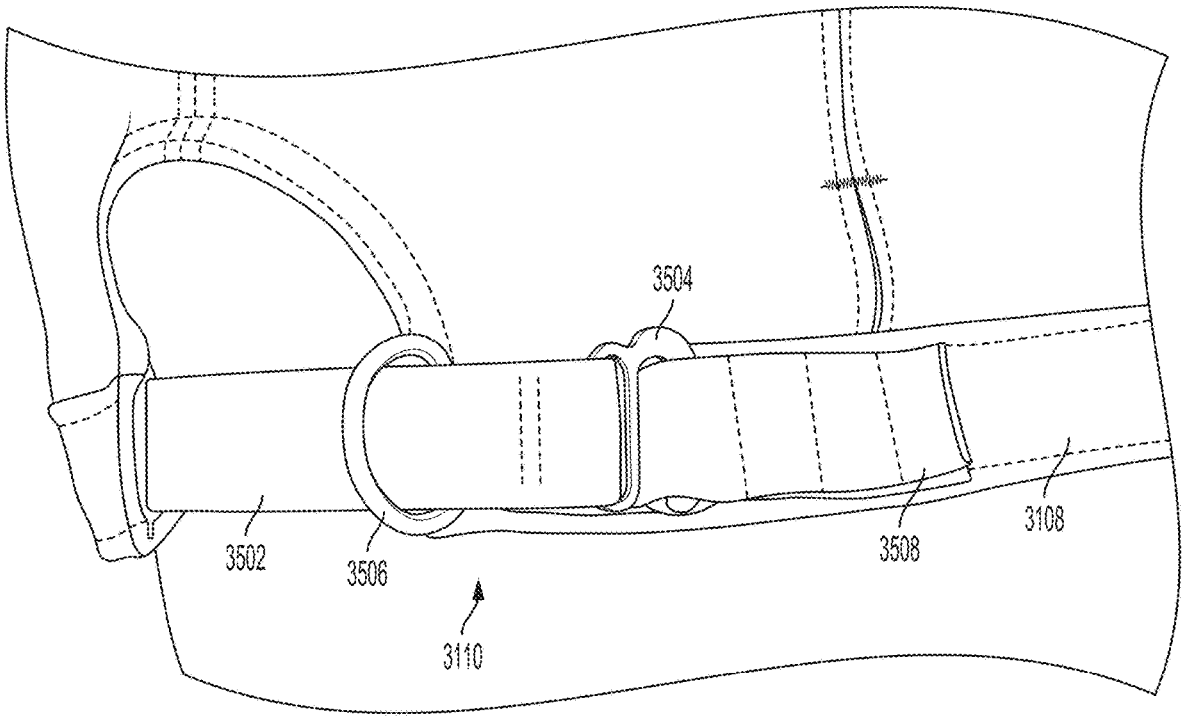
Figure 20:
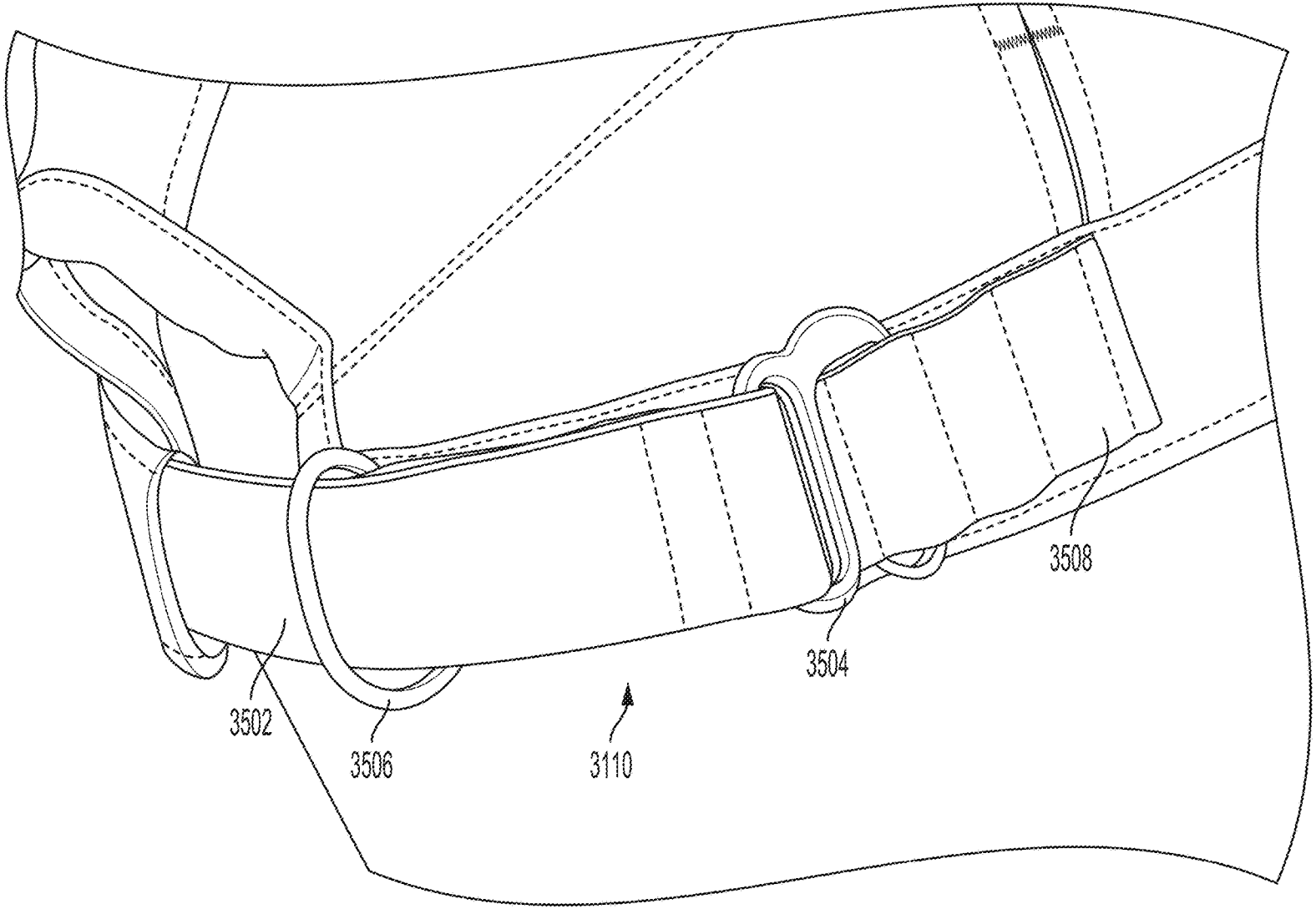
FIGS. 20 and 21 show example rear detail views of a size adjustment mechanism in accordance with one or more embodiments of the present disclosure.

Headwear 3100 may include a cap with a brim extending from or otherwise carried by a hat body 3104 (e.g., a crown). A headband 3108 may form another panel of the hat body and/or a junction between the hat body and the brim. For example, as shown in FIG. 18, the hat body may extend upward from the headband 3108 to form a crown that is configured to cover a head of a wearer of headwear 3100. Headband 3108 may extend around the circumference of the base of the hat body and house the sizing mechanism 3110. In some embodiments, the headband 3108 may extend around the entire circumference of the hat body (e.g., formed from a single, continuous loop of material) and/or may extend partly around the circumference (e.g., leaving an opening in the back of the hat body). For example, headband 3108 may be formed from a substantially rectangular panel that includes terminating ends that are spaced from one another. The size of the hat may be adjusted by pulling the terminating ends closer to one another (or farther apart) using sizing mechanism 3110.

Sizing mechanism 3110 may be provided to enable the headwear to be size adjustable and conform to a variety of head sizes and types. As illustrated, sizing mechanism 3110 includes a strap 3502 (e.g., a pullable strap) extending from an inner region of the cap to an outer region of the cap along a circumference of the hat body when disposed in a locked position. For example, strap 3502 may be housed and secured to the cap within a pocket formed in headband 3108 (e.g., sandwiched between at least two layers of material) at a first end and attached to a sizing clip 3504 (e.g., that forms a hook) at a second end, opposite from the first end. In this way, the strap 3502 may extend out of an opening in the headband 3108. In other embodiments, the strap may be attached to an interior of the cap (e.g., exposed to a wearer when placed on the head of the wearer and not within a pocket of material) or an exterior of the cap at the first end. Strap 3502 may include and/or be composed of flexible material, such as an elastic polymer, in order to provide a resilient tightening mechanism. In one example, strap 3502 may include sizing tape including webbing with elastic extension (e.g., ¾" elastic).

Figure 21:
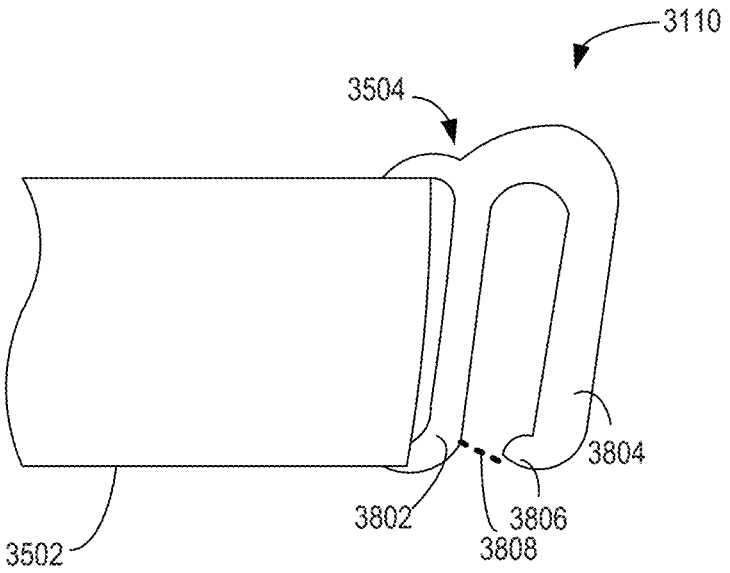

A guiding loop 3506 may be attached to an outer region of the cap near a fixed loop structure comprising a plurality of looped fasteners 508, also secured to the outer region of the cap. Guiding loop 3506 may be formed of flexible material (e.g., material that is more flexible than the material of strap 3502 and/or looped fasteners 3508) that may stretch to allow the passage of the sizing clip 3504 when the strap is directed through the guiding loop toward the looped fasteners. The guiding loop 3506 may also provide an anchor to which the sizing clip may be attached for additional size customization, as illustrated in FIG. 21. The looped fasteners may be made of the same material as strap 3502 or of a different material (e.g., with a different amount of flexibility). For example, the looped fasteners may be formed by attaching a strip of material to a headband of the cap (e.g., sewing vertical stitching) in multiple locations along the strip while the strip is allowed to loosely gather between attachments. The plurality of looped fasteners may be secured to the headband between a bottom circumferential edge of the headband and a top edge of the headband. Further, the plurality of looped fasteners may be attached to the headband at a position spaced apart from the opening from which the strap extends. For example, as shown in FIG. 18, the opening from which the strap extends may be positioned on a first side of the opening of the headband and the looped fasteners may be positioned on a second side of the opening of the headband, such that the strap extends across the opening of the headband. The looped fasteners may be any suitable size relative to the sizing clip 3504. In some embodiments, each of the looped fasteners may be a same size (e.g., have a same opening area when not stretched and/or have a same width/height). In other embodiments, one or more looped fasteners may be sized differently from one or more other looped fasteners. Although illustrated along a right side of the headwear, it is to be understood that the looped fasteners and other sizing mechanism elements may be located in any suitable region of the cap. For example, the sizing mechanism may be mirror-reversed or have a shifted location from the illustrated example and still fall within the scope of this disclosure.

The sizing clip 3504 may be formed of any suitable material. For example, sizing clip 3504 may be formed of metal or a metal alloy for strength, plastic for weight reduction, and/or any suitable combination of materials. The sizing clip may include a first closed loop that is attached to an associated loop of material from the strap 3502 and a second, partially open loop configured to be removably attached to a selected looped fastener (e.g., a selected loop) 3508. The partially open loop may include two substantially parallel prongs (e.g., an innermost prong 3802 of FIG. 21 forming a side of the first closed loop and an outermost prong 3804 of FIG. 21 spaced from the first closed loop) attached at one end and opened at another such that one of the prongs may pass through a looped fastener. As described above, one of the prongs may be configured to attach to guiding loop 3506 in order to provide additional width beyond that supplied by the looped fasteners.

In some embodiments, a hook 3806 (illustrated in FIG. 21) along the outermost prong 3804 may be provided that is configured to wrap around a lower edge of a selected looped fastener or guiding loop for further securing the sizing clip to the fastener/loop. In other embodiments, the hook may be absent in order to enable the sizing clip to pass through a looped fastener more easily. In some embodiments, a latch or other securing mechanism, represented by dashed line 3808 of FIG. 21, may be included on the hook to provide an additional locking mechanism for locking the hook onto a particular looped fastener or onto the guiding loop 3506. In additional or alternative embodiments, one or more additional sizing hooks may be including in the sizing mechanism. For example, utilizing a plurality of sizing hooks may enable the snapback force of the elastic strap to be divided across each hook, reducing the overall force on each hook and reducing the possibility that all of the hooks will be pulled from out of the respective loops.

In some embodiments, the opening of the looped material for each looped fastener may be sized to be close to a width of the widest point of the prong of the sizing clip. For example, the loop of the fastener may be sized such that the loop of the fastener stretches during insertion of the prong and snap back to a tight fit once the prong is in a locked position inside of the looped fastener. Any suitable number of looped fasteners may be provided. A shock cord elastic sizing tape retention loop may be utilized for the looped fasteners and/or the guiding loop.

The description of embodiments has been presented for purposes of illustration and description. Suitable modifications and variations to the embodiments may be performed in light of the above description. The described example headwear are exemplary in nature, and may include additional elements and/or omit elements. The subject matter of the present disclosure includes all novel and non-obvious combinations and sub-combinations of the various structures and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. Headwear, comprising:

a hat body;

a headband extending around an entire circumference of a base of the hat body, the hat body extending upward from the headband to form a crown configured to cover a head of a wearer of the headwear;

a sizing mechanism adapted to selectively adjust a size of the hat body, the sizing mechanism comprising:

a strap housed and secured to the hat body at a first end of the strap within a pocket formed in the headband and attached to a sizing clip at a second end, opposite from the first end, the strap comprised of sizing tape including webbing with an elastic extension;

a strip of material attached to the headband in multiple locations along the strip to form a plurality of vertically-extending looped fasteners, each looped fastener having a same width and height as other looped fasteners and positioned adjacent at least one other looped fastener, the sizing clip adapted to be removably attached to a selected looped fastener of the plurality of looped fasteners, and a guiding loop attached to the headwear intermediate the plurality of looped fasteners and the first end of strap, wherein the strap is configured to be accommodated within the guiding loop.

2. The headwear of claim 1, wherein the strap, at the first end, is sandwiched between at least two layers of material.

3. The headwear of claim 1, wherein the plurality of looped fasteners is secured to an exterior region of the hat body.

4. The headwear of claim 1, wherein the strip of material is attached to the headband via a plurality of segments of vertically-extending stitching.

5. The headwear of claim 1, wherein the strip of material comprises sizing tape including webbing.

6. The headwear of claim 1, wherein the sizing clip includes a hook.

7. Headwear, comprising:

a hat body;

a headband extending around a base of the hat body, the hat body extending upward from the headband to form a crown configured to cover a head of a wearer of the headwear;

a sizing mechanism adapted to selectively adjust a size of the hat body, the sizing mechanism comprising:

a strap housed and secured to the hat body at a first end of the strap within a pocket formed in the headband and attached to a sizing clip at a second end, opposite from the first end, the strap comprised of woven webbing and an elastic webbing anchor;

a plurality of looped fasteners attached to the headband, each looped fastener positioned adjacent at least one other looped fastener, the sizing clip adapted to be removably attached to a selected looped fastener of the plurality of looped fasteners, and a guiding loop attached to the headwear intermediate the plurality of looped fasteners and the first end of strap, wherein the strap is configured to be accommodated within the guiding loop.

8. The headwear of claim 7, wherein the strap extends out of an opening formed in the headband.

9. The headwear of claim 8, wherein the plurality of looped fasteners is attached to the headband at a position spaced apart from the opening.

10. The headwear of claim 7, wherein the plurality of looped fasteners is secured to the headband between a bottom circumferential edge of the headband and a top edge of the headband.

* * * * *